US007954747B2

(12) United States Patent
Chudy et al.

(10) Patent No.: US 7,954,747 B2
(45) Date of Patent: Jun. 7, 2011

(54) POUCH PACKAGE SPOOLER AND METHOD OF POUCH PACKAGE WEB MANAGEMENT

(75) Inventors: Duane S. Chudy, Lincolnshire, IL (US); Michael B. Bishop, Twin Lakes, WI (US)

(73) Assignee: Chudy Group, LLC, Powers Lake, WI (US)

( * ) Notice: Subject to any disclaimer, the term of this patent is extended or adjusted under 35 U.S.C. 154(b) by 143 days.

(21) Appl. No.: 12/139,236

(22) Filed: Jun. 13, 2008

(65) Prior Publication Data

US 2009/0308964 A1 Dec. 17, 2009

(51) Int. Cl.
*B65H 19/22* (2006.01)

(52) U.S. Cl. ..... 242/533.8; 242/590; 242/597.1

(58) Field of Classification Search ..... 242/533.8, 242/538, 412, 590, 597.1, 613; 53/451
See application file for complete search history.

(56) References Cited

U.S. PATENT DOCUMENTS

| | | | | |
|---|---|---|---|---|
| 2,396,805 | A * | 3/1946 | Schwartz | 242/423.1 |
| 2,635,822 | A * | 4/1953 | Burman, Jr. | 242/538 |
| 4,070,047 | A | 1/1978 | Lindelow | |
| 4,260,116 | A | 4/1981 | Collin | |
| 4,832,074 | A | 5/1989 | Li | |
| 5,005,777 | A | 4/1991 | Fernandez | |
| 5,215,272 | A | 6/1993 | Sauber | |
| 5,398,089 | A | 3/1995 | Stiehler | |
| 5,437,417 | A | 8/1995 | Kammann | |
| 5,639,045 | A | 6/1997 | Dorfel | |
| 5,645,245 | A | 7/1997 | Kremar | |
| 5,839,257 | A | 11/1998 | Soderstrom et al. | |
| 6,027,066 | A * | 2/2000 | Street | 242/532.5 |
| 6,041,930 | A * | 3/2000 | Cockburn | 206/484 |
| 6,330,351 | B1 | 12/2001 | Yasunaga | |
| 6,363,219 | B1 | 3/2002 | Cornell | |
| 6,505,461 | B1 | 1/2003 | Yasunaga | |
| 6,554,217 | B1 | 4/2003 | Rodriguez | |
| 7,093,472 | B1 | 8/2006 | Shore et al. | |
| 7,191,972 | B2 | 3/2007 | Peter | |
| 7,261,252 | B2 | 8/2007 | Nicolai et al. | |
| 7,344,105 | B2 | 3/2008 | Lindsey | |
| 7,364,108 | B2 | 4/2008 | Kim et al. | |
| 7,536,938 | B2 | 5/2009 | Kim | |
| 7,540,222 | B2 | 6/2009 | Kim | |

OTHER PUBLICATIONS

Global Factories B.V. The Hague, The Netherlands. <www.gf-medical.com>. Website downloads. 22 pages. Date: Copyright 2007.
The Gadgeteer. "Hydro-Industries ReelSmarl Automatic Hose Reel." 10 pages. Date: Aug. 2006.

* cited by examiner

*Primary Examiner* — Sang Kim
(74) *Attorney, Agent, or Firm* — Jansson Shupe & Munger Ltd.

(57) ABSTRACT

A spooler for taking up a pouch package web output from a pouch package web source and a method for management of a pouch package web output from said source. In embodiments, the spooler comprises a support structure, a rotatable spindle secured with respect to the support structure, a drive apparatus in power-transmission relationship with the spindle for powering spindle rotation and control apparatus. A spool may be mounted on the spindle. Pouch package web output from the pouch package web source is wound onto the spool, providing a convenient and efficient means for managing the pouch package web.

20 Claims, 19 Drawing Sheets

POUCH PACKAGE SPOOLER AND METHOD OF POUCH PACKAGE WEB MANAGEMENT

FIELD

The field relates generally to medication management and, more particularly, to management of pouch-package-type medication packages.

BACKGROUND

Prescription medications, over-the-counter (OTC) products, nutriceutical products and other products are frequently required to be packaged in unit-of-use packages referred to as "pouch packages." For convenience and brevity these products will be referred to herein simply as "medication." Each pouch package may include one or more medication, typically in the form of a tablet or capsule.

The pouch packages containing the medication are typically formed in a continuous web of film-type packaging material resulting in formation of a pouch package web. The pouch packages may be arranged and organized in the pouch package web in various ways to facilitate compliance with the patient's prescription regimen. For example, the pouches could be arranged in the order in which the medication is to be taken by the patient. As a specific example, four serially-arranged pouch packages could include different types of medication to be taken, respectively, in the morning, afternoon, evening, and at bedtime.

Medication is frequently packaged in pouch packages without regard to any specific patient, simply to provide the medication in a convenient form for subsequent use. For example, it may be desirable for a pharmacy to package and have available a quantity of a frequently-used medication. Packaging of such medication in pouch packages formed in a continuous pouch package web represents a convenient way to manage and administer such medications.

Most typically, packaging of the medication into the pouch packages is accomplished by means of an automatic tablet packager which includes medication dispensers and a packaging apparatus. Typically, the medication dispensers used by the automatic tablet packager are a plurality of cassettes, each holding one type of prescription medication. The packaging apparatus is typically a form-fill-seal machine specialized for use in packaging medication dispensed from the dispensers. The cassettes are activated in coordination with the packaging apparatus so that the appropriate medication is packaged according to a patient's prescription order or according to other instructions provided by a pharmacy technician.

The medication is dropped onto the packaging material web in the appropriate order and the packaging apparatus fuses or welds the packaging material to form a discrete pouch for the medication. A continuous pouch package web including the pouch packages formed one-after-the-other therein is created by the automatic tablet packager during this dispensing and packaging process.

The pouch package web including the pouch packages is output from the automatic tablet packager. In many pharmacies, the pouch package web output from the automatic tablet packager simply falls in a heap onto the floor adjacent the packager or into a tote or box in a long, continuous web. A technician must then cut or otherwise sever the pouch package web into separate segments for each prescription order being filled or otherwise separate the web into segments as heeded. The segments are then delivered to the patient or are otherwise distributed as required.

As can be easily appreciated, management of many linear feet of a continuous pouch package web can be inconvenient and inefficient. The technician is typically required to separate the pouch packages either adjacent the automatic tablet packager, or the technician must gather the mass of pouch packages and take them to a workstation in order to perform this work. Performing this work adjacent the automatic tablet packager, rather than at a workstation, is not optimally efficient. Handling a potentially tangled mass of pouch packages at a workstation is also not optimally efficient. Carrying of a long, continuous mass of pouch packages to a hospital ward or other location for administration to patients is also inconvenient and can be completely impractical.

It would be an advance in the art to provide apparatus and methods for managing pouch package webs, which would improve the organization and delivery of medication and other products, which would improve efficiency and generally improve the quality of patient care.

SUMMARY

Apparatus and methods for management of pouch package webs are shown and described. In one aspect, a spooler for taking up a pouch package web is provided. The web may be output from a pouch package web source, such as an automatic tablet packager. Preferably, the spooler comprises a support structure, a rotatable spindle secured with respect to the support structure, a drive apparatus in power-transmission relationship with the spindle for powering spindle rotation and control apparatus. The spindle receives a spool mounted thereon. Pouch package web output from the pouch package web source is wound onto the spool, providing a convenient and efficient means for managing the pouch package web. It is preferred that the spool is removable from the spindle so that an unloaded spool may be substituted in place of a spool loaded with pouch package web.

In preferred embodiments, control apparatus may be provided to stop spool rotation automatically. Preferably, the control apparatus automatically stops spool rotation if the pouch package web source stops output of the pouch package web. In embodiments, the control apparatus automatically stops spool rotation responsive to other conditions, such as severing of the web, or lack of tension on the web. Other control apparatus embodiments may be utilized.

In another aspect, there is described a method for management of a pouch package web output from a pouch package web source. The method comprises positioning a spooler adjacent to the pouch package web source, associating the pouch package web from the pouch package web source with a spool mounted on the spooler, outputting the pouch package web from, the pouch package web source and rotating the spool with the spooler to wind the pouch package web into a roll on the spool.

Additional steps which may be performed include severing of the pouch package web output from the pouch package web source once an amount of the pouch package web is wound onto the spool and removing the spool from the spooler. In aspects of the method, the loaded spool may be placed on a rack for ease of delivery or subsequent handling of the pouch package web.

It is preferred that the method further include stopping spool rotation responsive to stoppage of pouch package web outputting. In a highly preferred embodiment, the stopping of spool rotation is responsive to an increase in pouch package web tension which occurs when output from the pouch package web source stops, yet the spool continues to rotate. It is also highly preferred that the stopping of spool rotation is responsive to a decrease in pouch package web tension which occurs, for example, when a technician severs the pouch package web after the spool is fully loaded.

BRIEF DESCRIPTION OF THE DRAWINGS

Exemplary spooler apparatus and methods may be understood by reference to the following description taken in conjunction with the accompanying drawings, in which like reference numerals identify like elements throughout the different views. For convenience and brevity, like reference numbers are used for like parts amongst the embodiments. The drawings are not necessarily to scale, emphasis instead being placed upon illustrating the principles of the invention. In the accompanying drawings.

DETAILED DESCRIPTION

An exemplary spooler 11 is illustrated in FIGS. 1-9A and 12-15C. Spooler 11 is preferably used to manage medications 13 packaged in one or more pouch packages 15 formed in a pouch package web 17. FIG. 10 illustrates a portion of an exemplary pouch package web 17 of a type which may be used with spooler 11 including medication-containing pouch packages 15 formed therein. The term "medication" is intended to be a broad term which encompasses a diverse range of products including prescription pharmaceutical products, over-the-counter (OTC) products, nutriceutical products and products generally capable of packaging in pouch packages 15.

Figure 12:
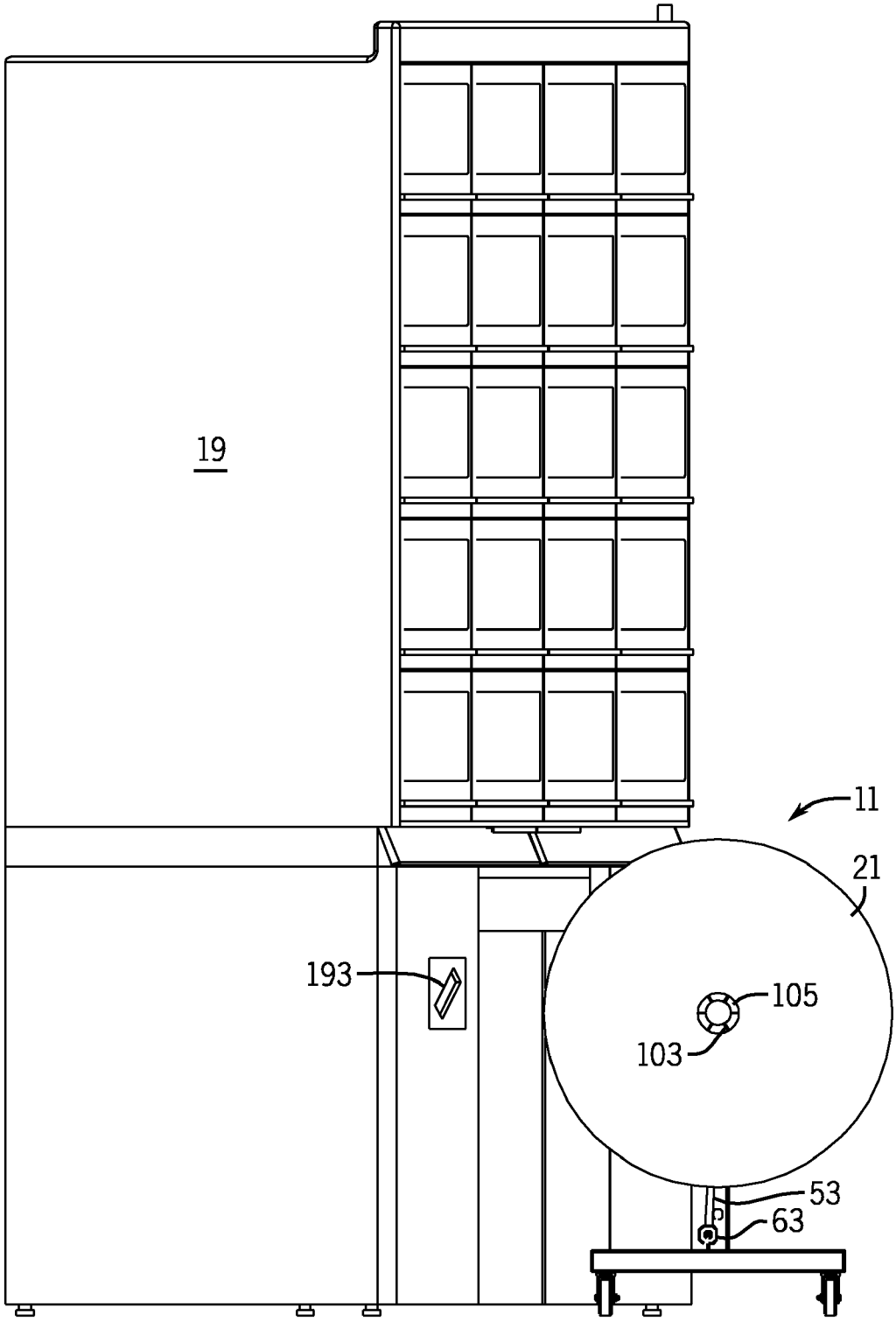
FIG. 12 is a schematic illustration showing a representative spooler and an automatic tablet packager showing the spooler in an "off" state which occurs when pouch package web is not being wound onto spool.
Figure 13:
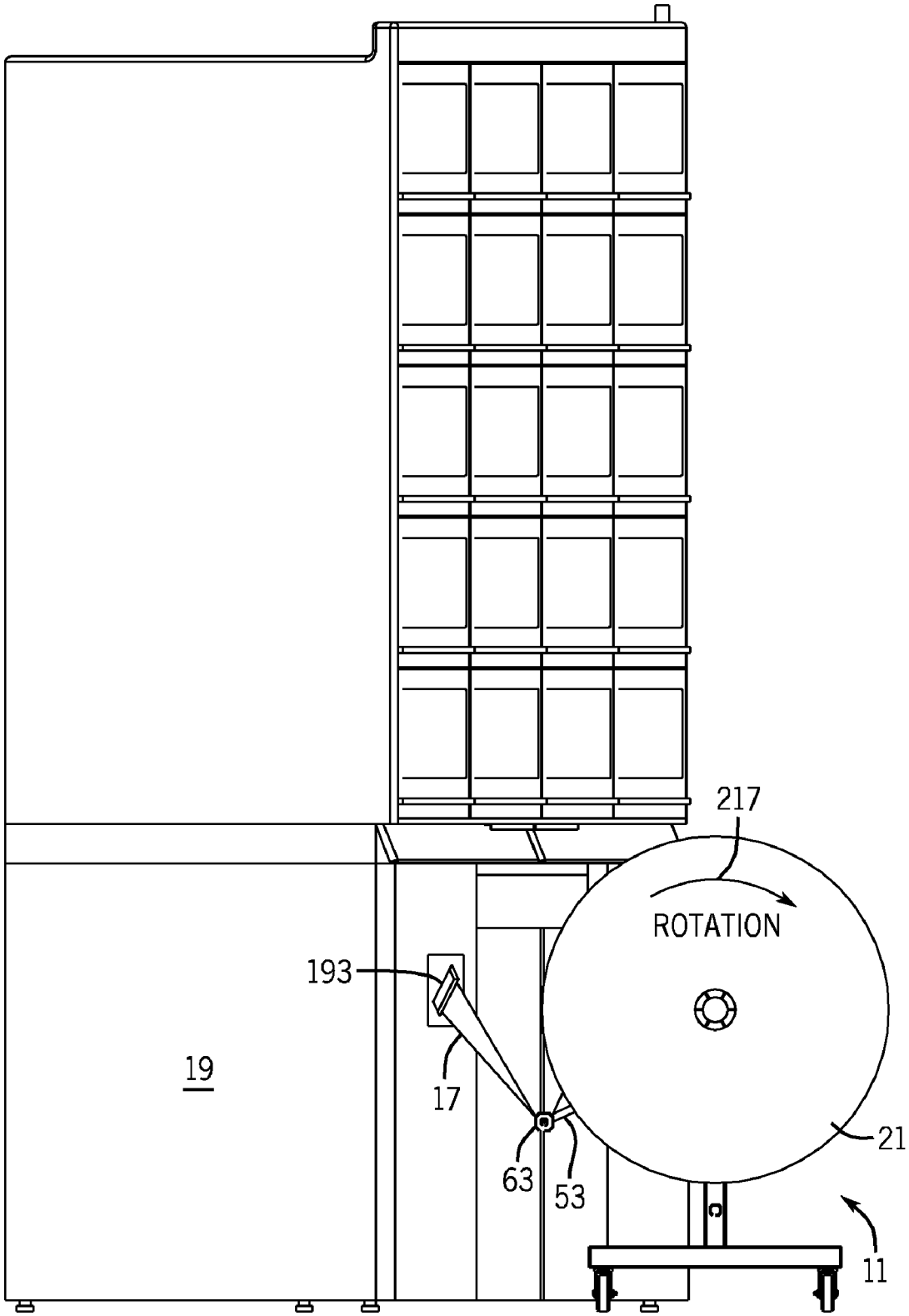
FIG. 13 is a further schematic illustration showing the representative spooler in an "on" state with an exemplary pouch package web being output from the automatic tablet packager and being wound onto a spool.
Figure 14:
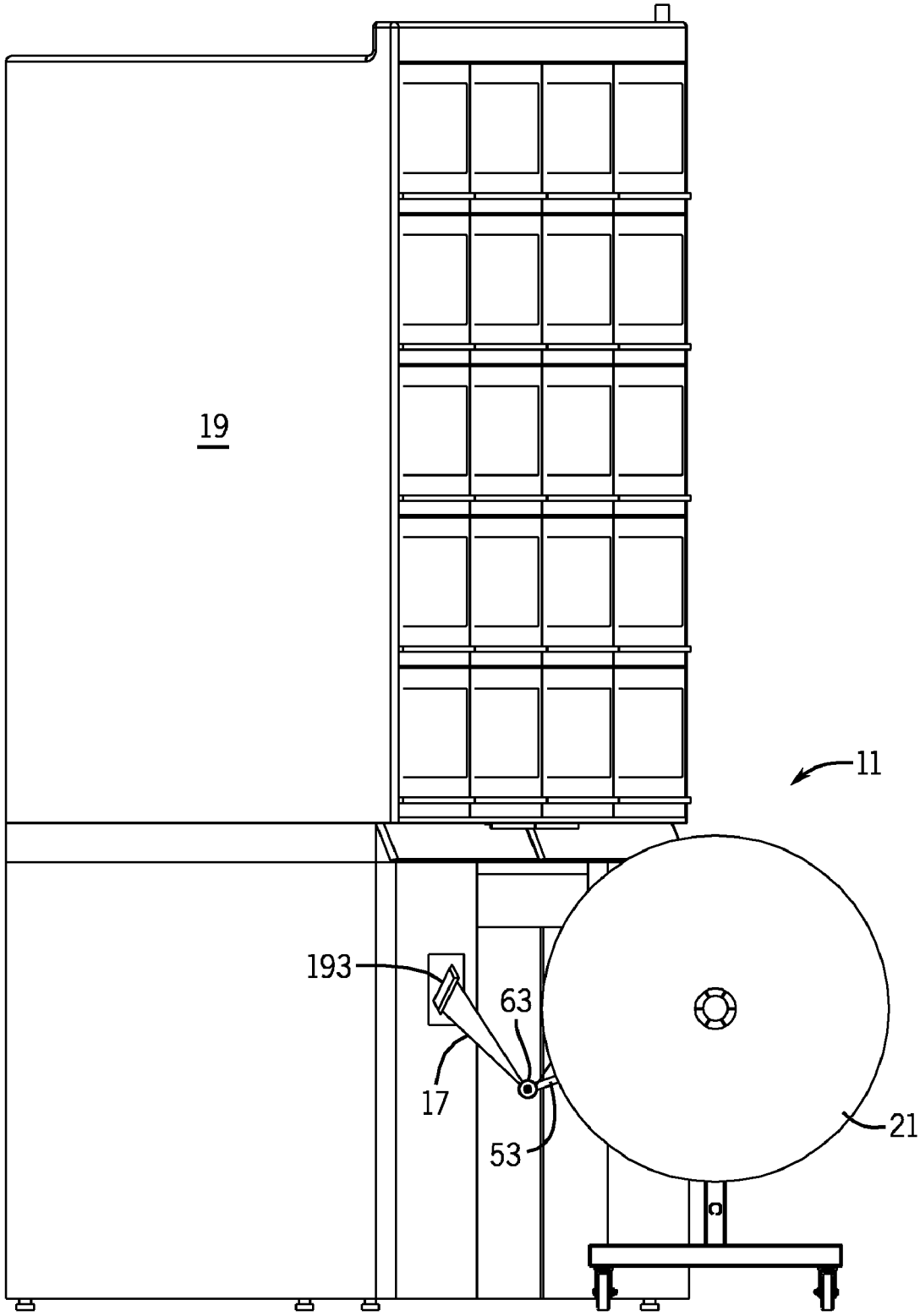
FIG. 14 is a further schematic illustration showing the representative spooler in an "off" state which occurs when the automatic tablet packager stops output of the pouch package web.

The pouch package web 17 may be output from an automatic tablet packager 19, an example of which is shown schematically in FIGS. 12-14. Spooler 11 takes up the pouch package web 17 from automatic tablet packager 19 by winding the pouch package web 17 onto spool 21, providing a convenient alternative to allowing the pouch package web 17 to simply fall from the automatic tablet packager 19 into a heap on the floor or into a box or tote adjacent packager 19. Automatic tablet packager 19 is one example of a pouch package web 17 source. Other sources of pouch package web 17 may be utilized. For example, a pouch package web source could be another spooler 11 should the pharmacy wish to transfer pouch package web 17 from one spool 21 to another.

Figure 16:
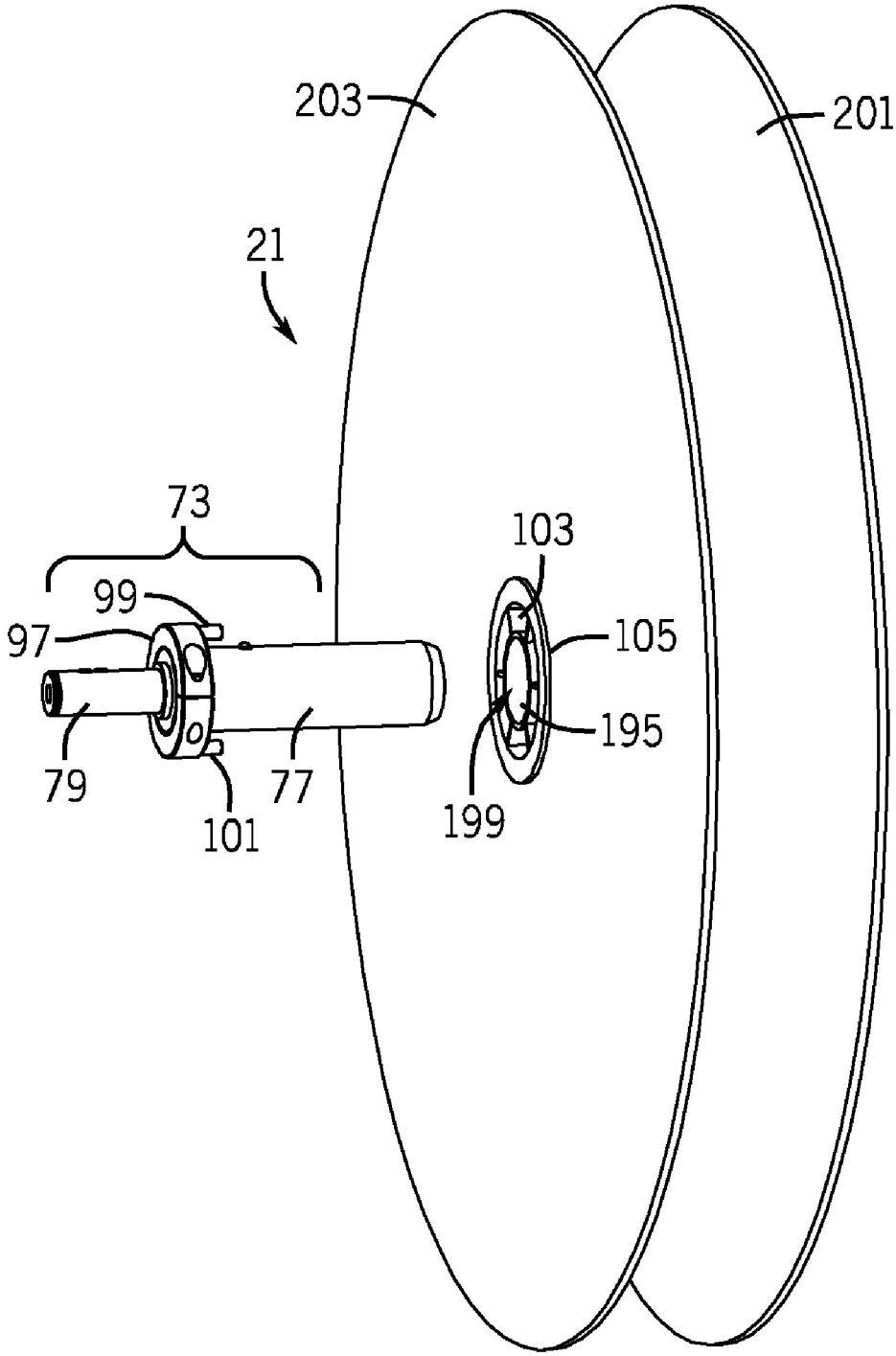
FIG. 16 is a perspective view of an exemplary spool.

With the pouch package web 17 wound conveniently onto spool 21, the pouch package web 17 may be handled or processed as desired. For example, the spool 21 may be loaded with all medications, required by all patients in an entire hospital or long-term-care facility ward and the spool 21 and pouch package web 17 may be taken to the ward for convenient administration of the medication. As illustrated in FIG. 16, a mobile rack 23 could be provided to conveniently move loaded spools 21 to the ward or other location.

By way of further example, spool 21 and pouch package web 17 could simply be taken to a pharmacy workstation for convenient separation of each patient's pouch packages 15 from web 17 by a pharmacy technician.

As yet another example, multiple spools 21 could be loaded and temporarily stored on mobile rack 23 for processing or medication administration at a future point in time. This would permit automatic tablet packager 19 to package medication 13 at off-peak times. These and other uses of spooler 11 desirably contribute to overall pharmacy efficiency, contribute to the control of costs and improve the quality of patient care.

The automatic tablet packager 19 shown is an ATP Model 320 available from The Chudy Group, LLC of Powers Lake, Wis. Persons of skill in the art will appreciate that other types of pouch-packaging apparatus may be utilized to package products in pouch packages.

Turning then to the example of FIGS. 1-9A and 12-15C, spooler 11 includes a support structure 25 including base 27 and post 29 extending upwardly from base 27. Exemplary base 27 includes mid-portion 31 and front and rear end portions 33, 35 joined to mid-portion 31 to provide a preferred H-shaped configuration. Mid-portion and front and rear end portions 31-35 and post 29 are preferably made of lightweight tubular material, such as extruded aluminum, and may be joined together by any suitable means such as by welding or mechanical fasteners. End caps 37 may be inserted into each end of mid and end portions 31-35 and post 29 to close the tubular ends of these support structure 25 parts.

Figure 1:
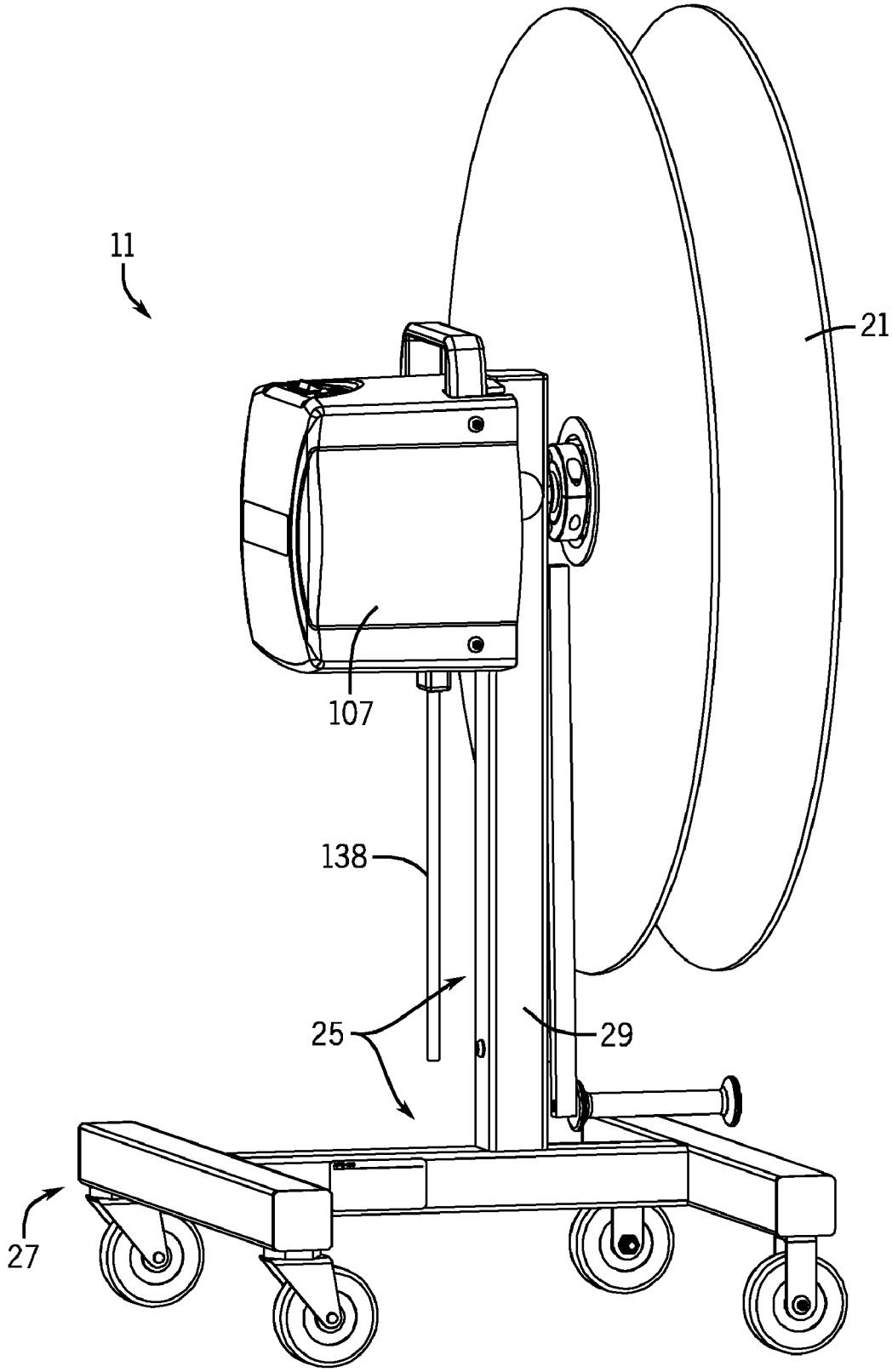
FIG. 1 is a rear-side perspective view of an exemplary spooler.
Figure 2:
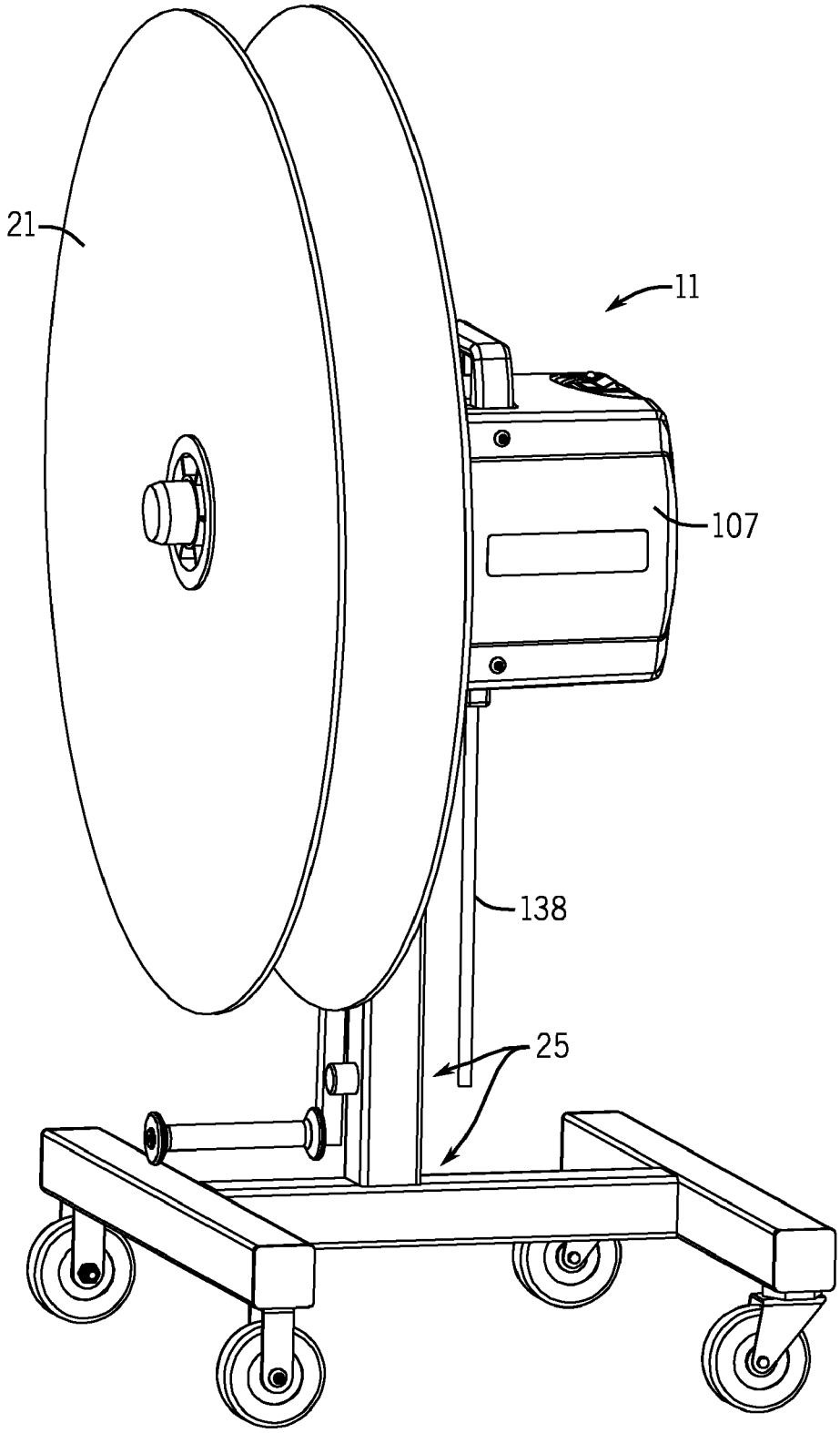
FIG. 2 is a front-side perspective view of the spooler of FIG. 1.
Figure 3:
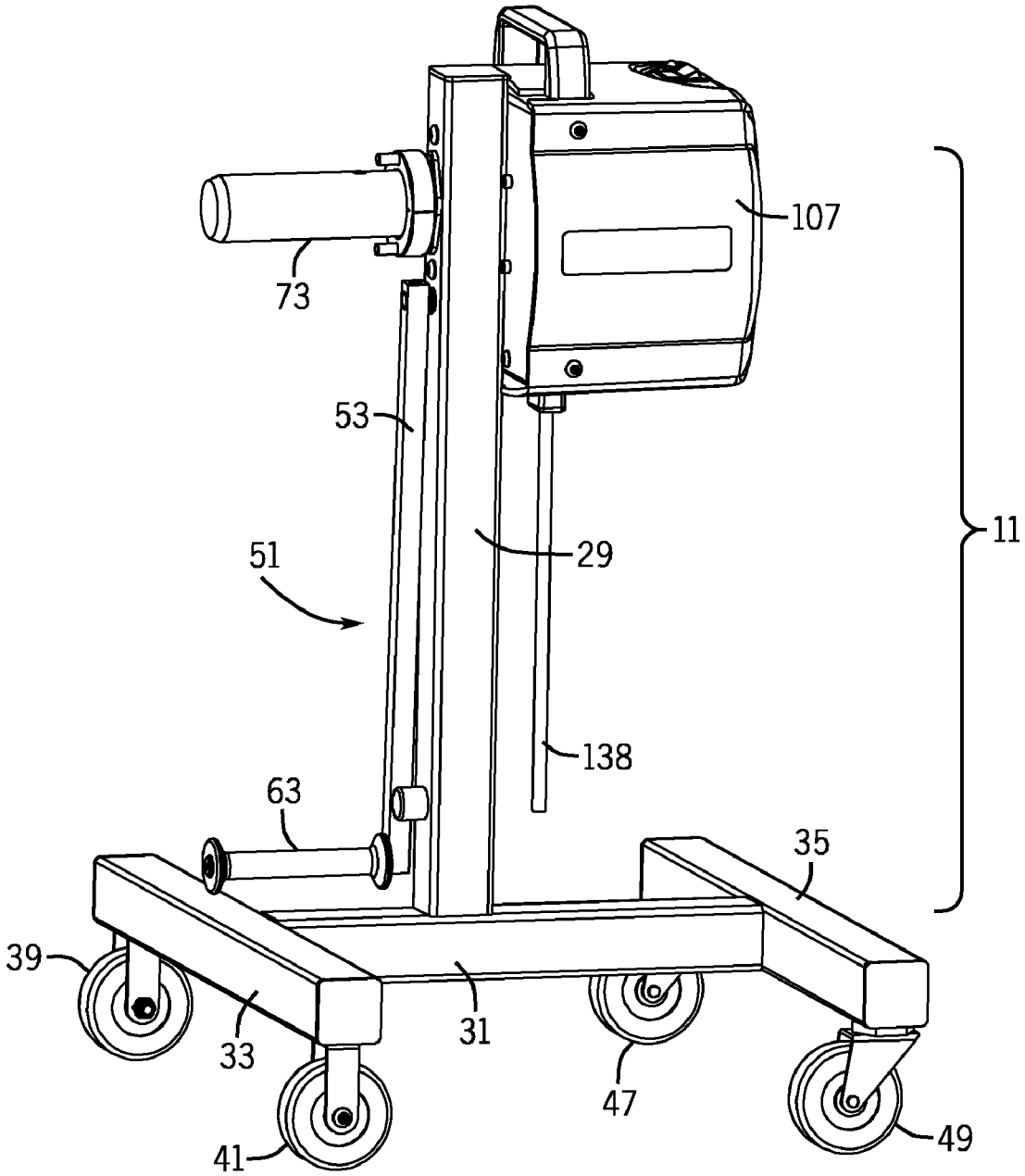
FIG. 3 is a front-side perspective view of the spooler of FIG. 1, but with the spool removed.
Figure 4:
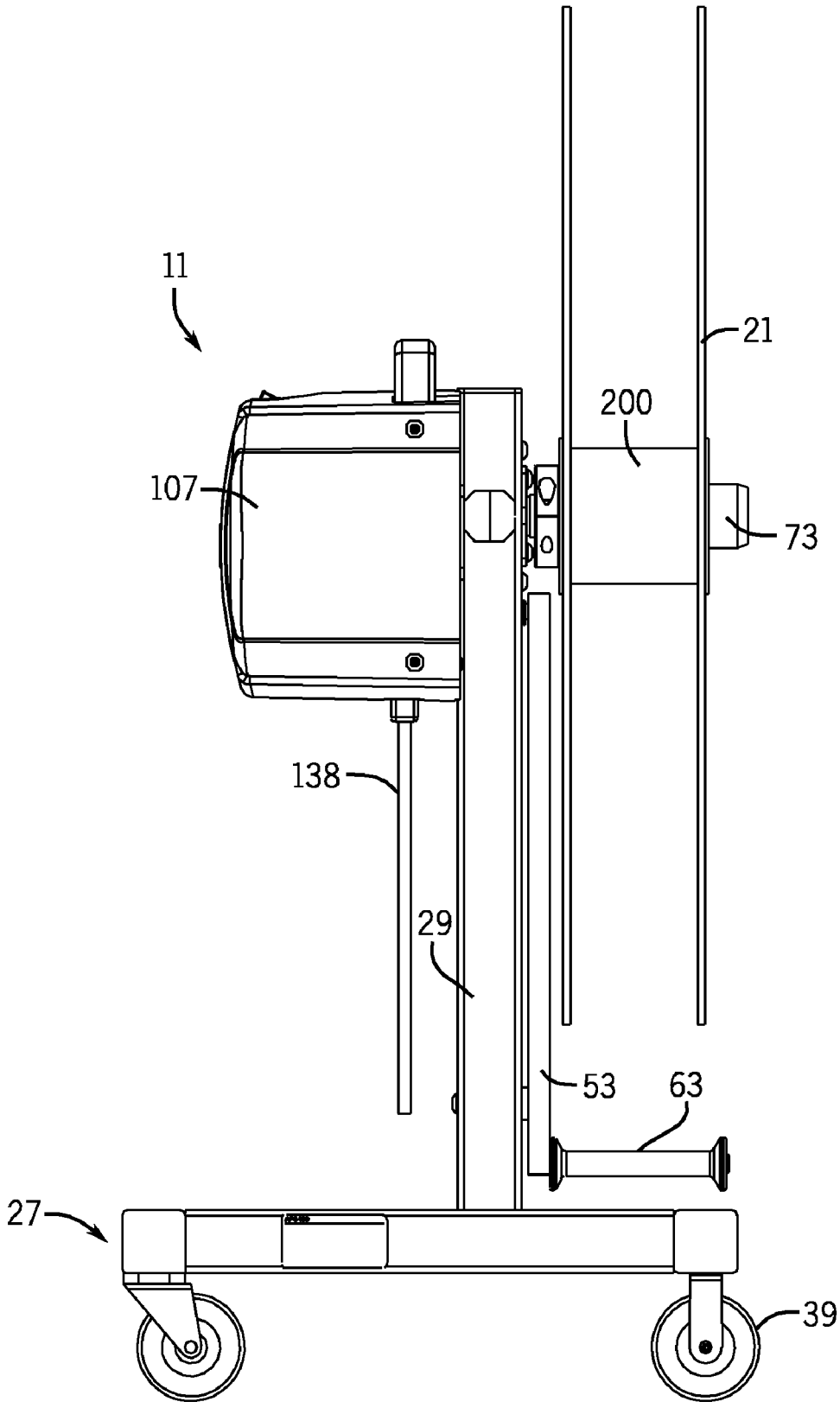
FIG. 4 is a side view of the spooler of FIG. 1.
Figure 5:
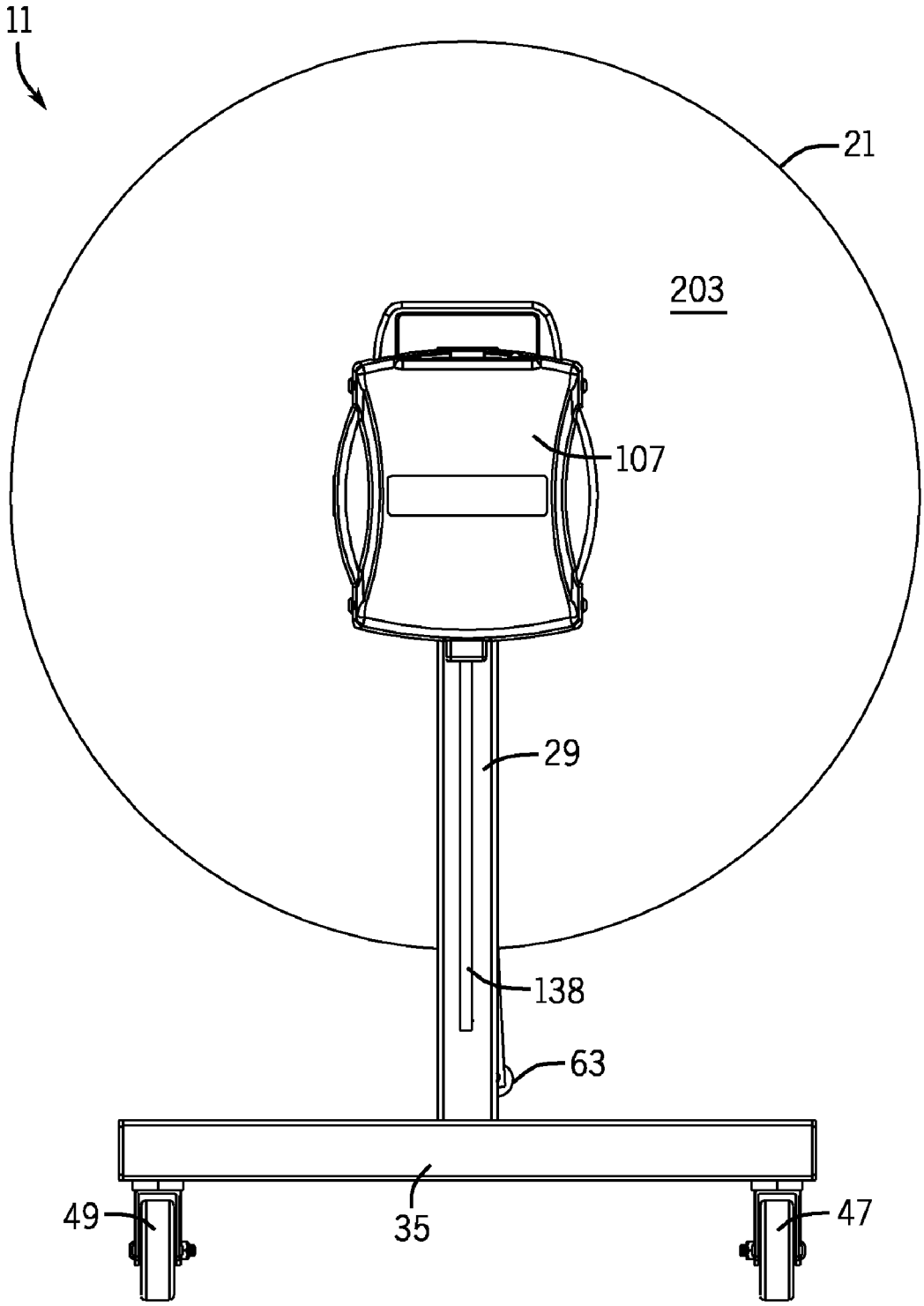
FIG. 5 is rear view of the spooler of FIG. 1.
Figure 6:
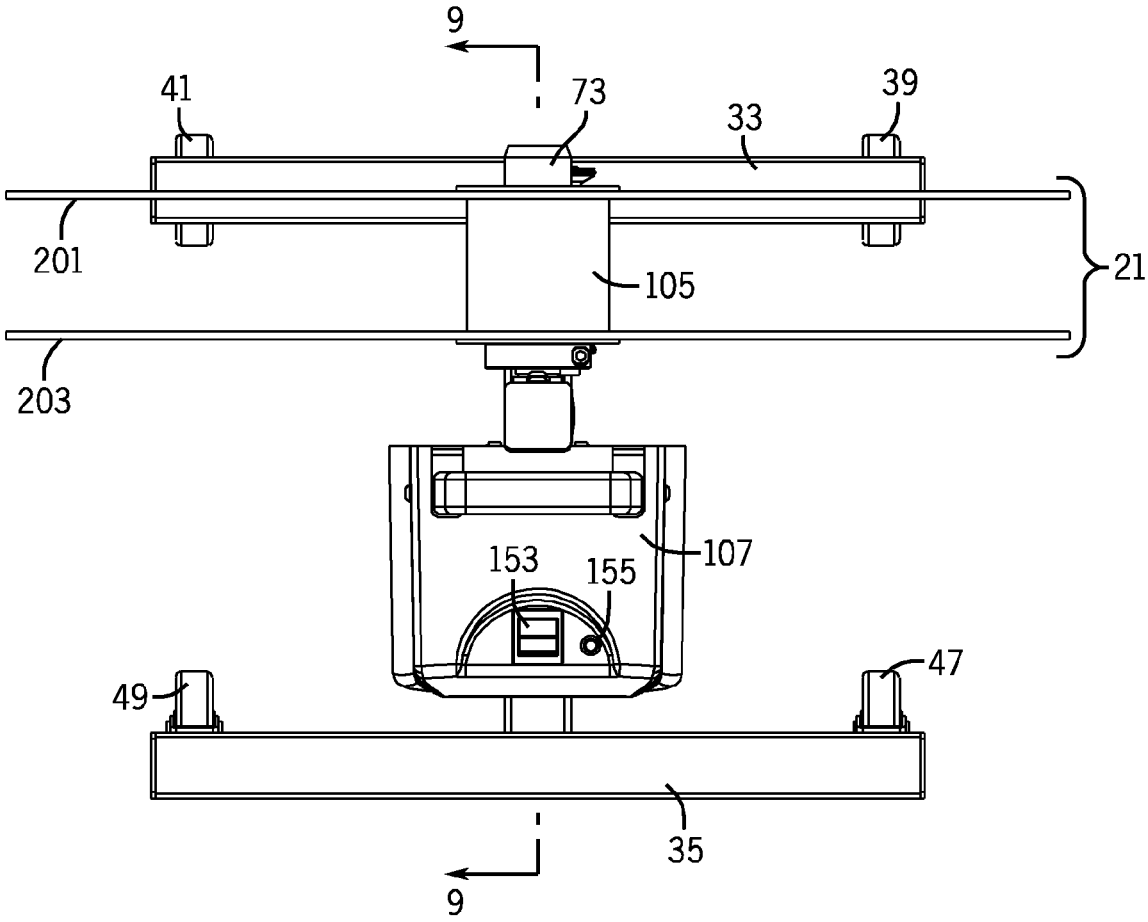
FIG. 6 is a top view of the spooler of FIG. 1.
Figure 7:
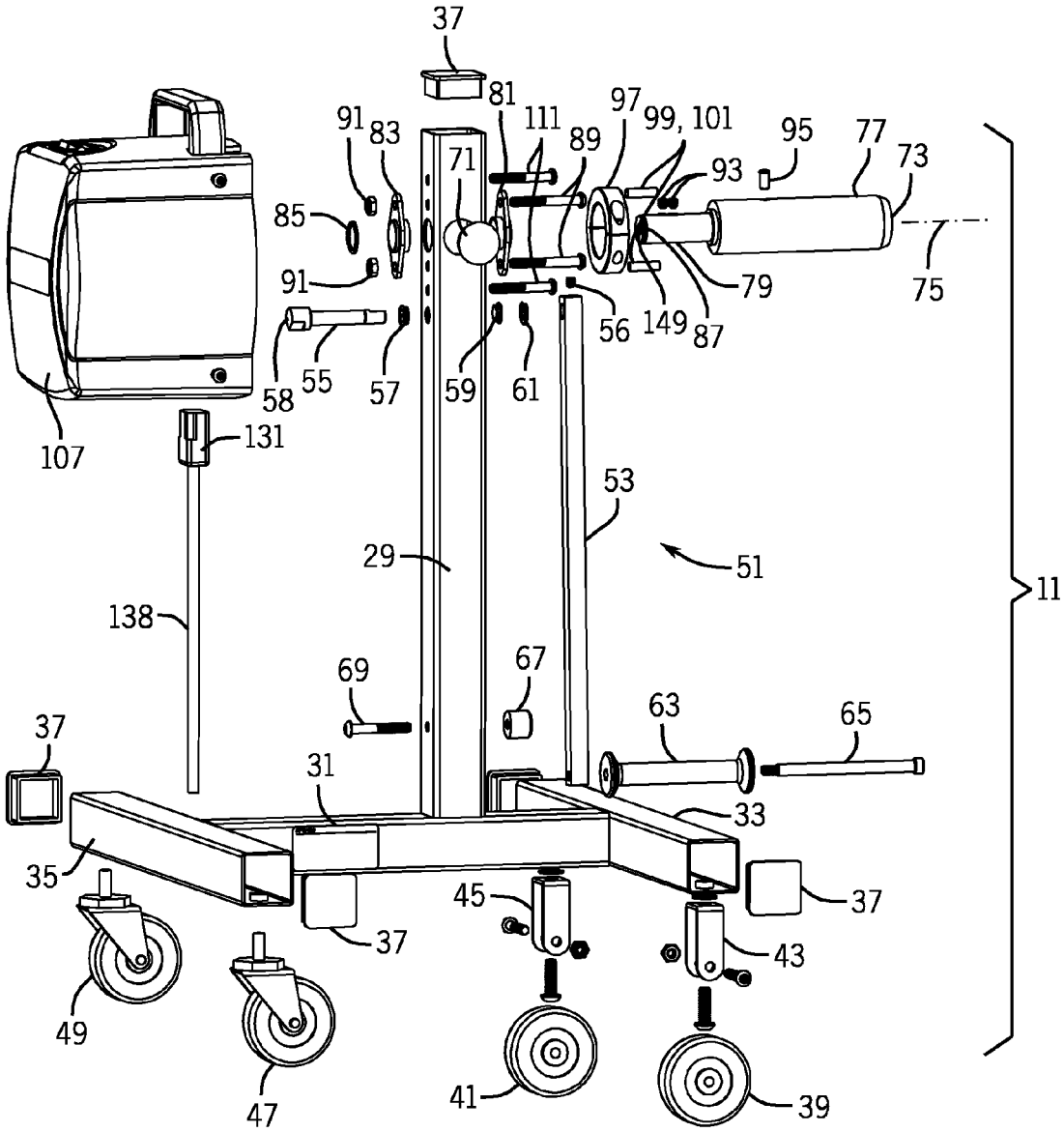
FIG. 7 is an exploded view of the spooler of FIG. 1.

In the embodiment, spooler 11 is equipped with a pair of front wheels 39, 41 secured to front end portion 33 by wheel mounts 43, 45 and associated bolts and lock nuts as shown in FIG. 7. A pair of caster wheels 47, 49 are secured to rear portion 35 by any other suitable arrangement to facilitate movement of spooler 11 by a technician or other attendant.

Exemplary tensioner assembly 51 is provided to place tension on pouch package web 17 during take up of web 17 onto spool 21. In the embodiment, tensioner assembly 51 and an associated micro-switch 157 serve as a control apparatus 52 for spooler 11. Such exemplary control apparatus 52 automatically deactivates spooler 11 when automatic tablet packager 19 stops output of web 17 (FIGS. 14 and 15C). Exemplary control apparatus 52 also deactivates spooler 11 when there is a lack of tension on web 17, such as when a technician severs the web 17 after the spool 21 is fully loaded, or if the web 17 were to break, or if the spooler 11 was idle and was not being used to manage a pouch package web 17. This latter control is a safety feature preventing inadvertent activation of spooler 21. Operation of such control apparatus 52 is described further below.

Referring to FIGS. 1-4 and 7, tensioner assembly 51 preferably includes arm 53 pivotably secured at one end to post 29 by pin 55 inserted through bushings 57, 59 in post 29 and e-clip 61 to provide spacing between post 29 and arm 53. A set screw 56 secured to pin 55 end limits lateral movement of arm 53 so that arm 53 remains on pin 55. A cam 58 is provided in the opposite end of pin 55 to operate micro-switch 157. In the example, arm 53 hangs downwardly from pin 55 in a generally vertical orientation by means of gravity when at rest. At an opposite end of tensioner arm 53, a guide in the form of preferred roller 63 is secured to arm 53 by shoulder bolt 65 inserted through bushing 63 and secured to arm 53. Roller 63 applies force against web 17 placing web 17 in tension. Roller 63 rotates as packaging material web 17 rides under and against roller 63 during the take-up process as described herein. A bumper 67 is secured to a post 29 lower end by bolt 69 to limit arm 53 pivoting movement when arm 53 roller 63 is not in contact with pouch package web 17 and arm 53 is at rest.

To facilitate ease of spooler 11 movement, a handle 71 with a sphere-shaped gripping end knob may be affixed to an upper end of post 29.

Referring to FIGS. 7, 9, 9A, and 16, spindle 73 is provided to support a spool 21 mounted thereon. In the embodiment, spool 21 may be mounted on spindle 73 for take up of pouch package web 17 and may be removed from spindle 73 to permit desired use of the loaded spool 21 or to permit an unloaded spool 21 to be placed thereon.

Spindle 73 has a rotational axis 75 with a generally cylindrical spool-mounting portion 77 and a co-axial drive-engagement portion 79. In the embodiment, spindle 73 rotational axis 75 is generally horizontal. Drive-engagement portion 79 is seated in bushings 81, 83 with lateral movement limited by retainer 85 clipped to annular groove 87 to support spindle 73 on post 29. Bushings 81, 83 are secured to post 29 by bolts 89 and lock washers 91. In the embodiment, bushings 81, 83 may be made of any low-friction material, such as nylon 6-6, because spindle 73 rotates at a relatively low rate of revolutions per minute (rpm). For example, a rate of about 27 rpms has been found to be satisfactory for a broad range of spooler 11 applications. Bearings may be used in place of bushings 81, 83. Set screws 93 are provided on spindle drive-engagement portion 79. Set screws 93 are extended into slot 151 of drive apparatus 107 output shaft 147 so that rotation of output 147 shaft positively rotates spindle 73 and any spool 21 mounted thereon.

Figure 9:
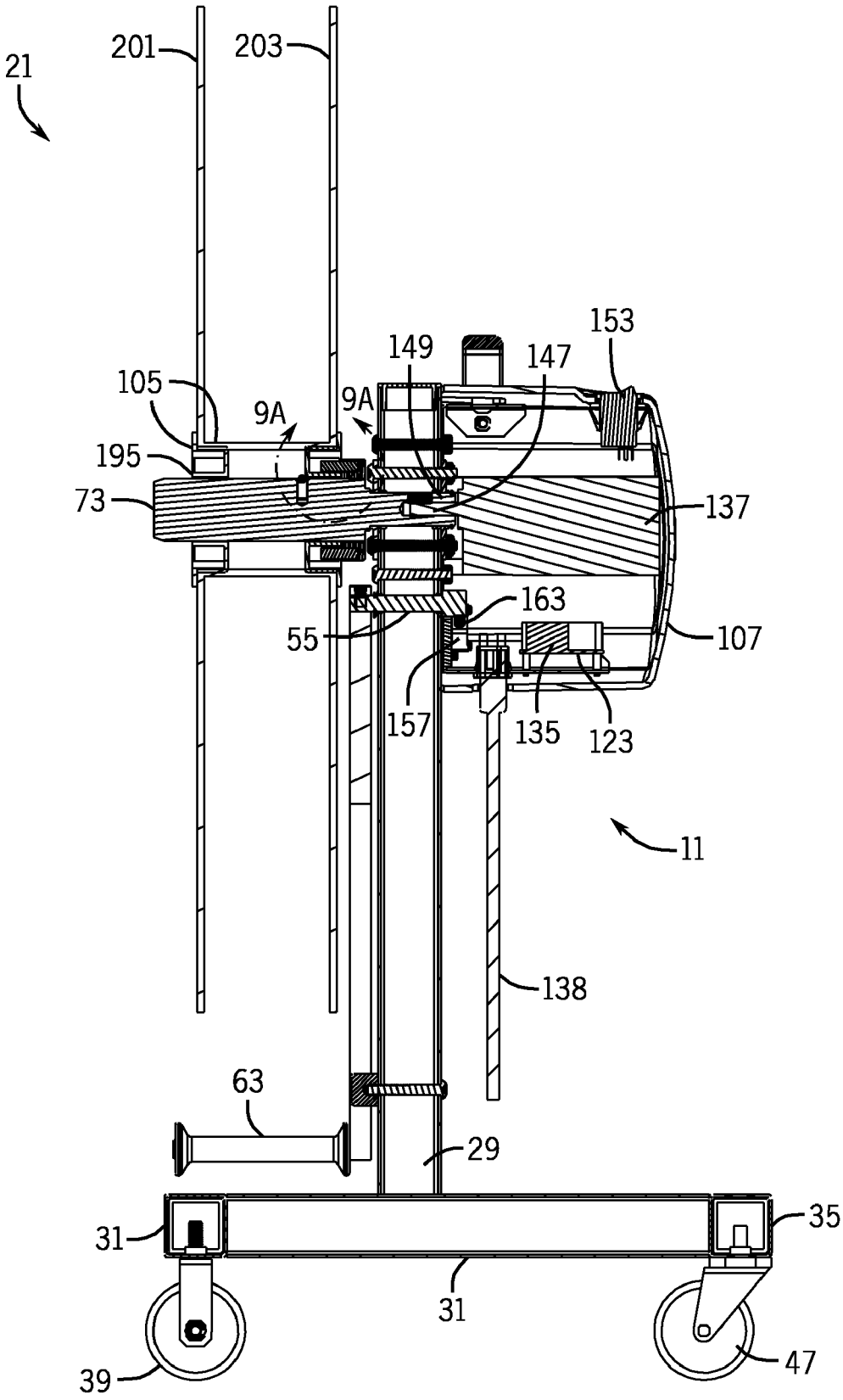
FIG. 9 is a section view of an exemplary spool and spooler taken along section line 9-9 of FIG. 6.
Figure 9A:
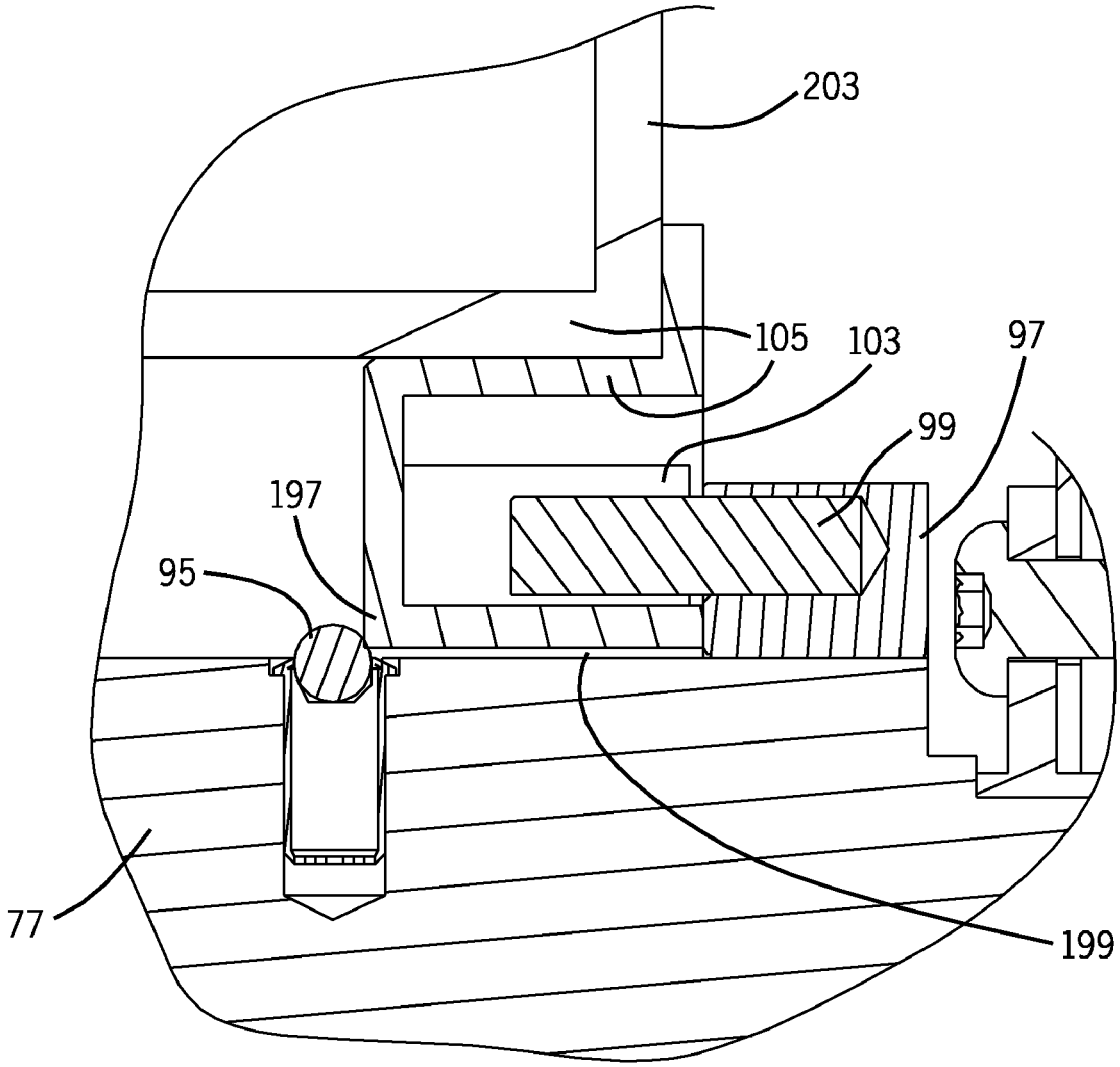
FIG. 9A is an enlarged partial view of FIG. 9 taken along section line 9A-9A of FIG. 9.
Figure 10:
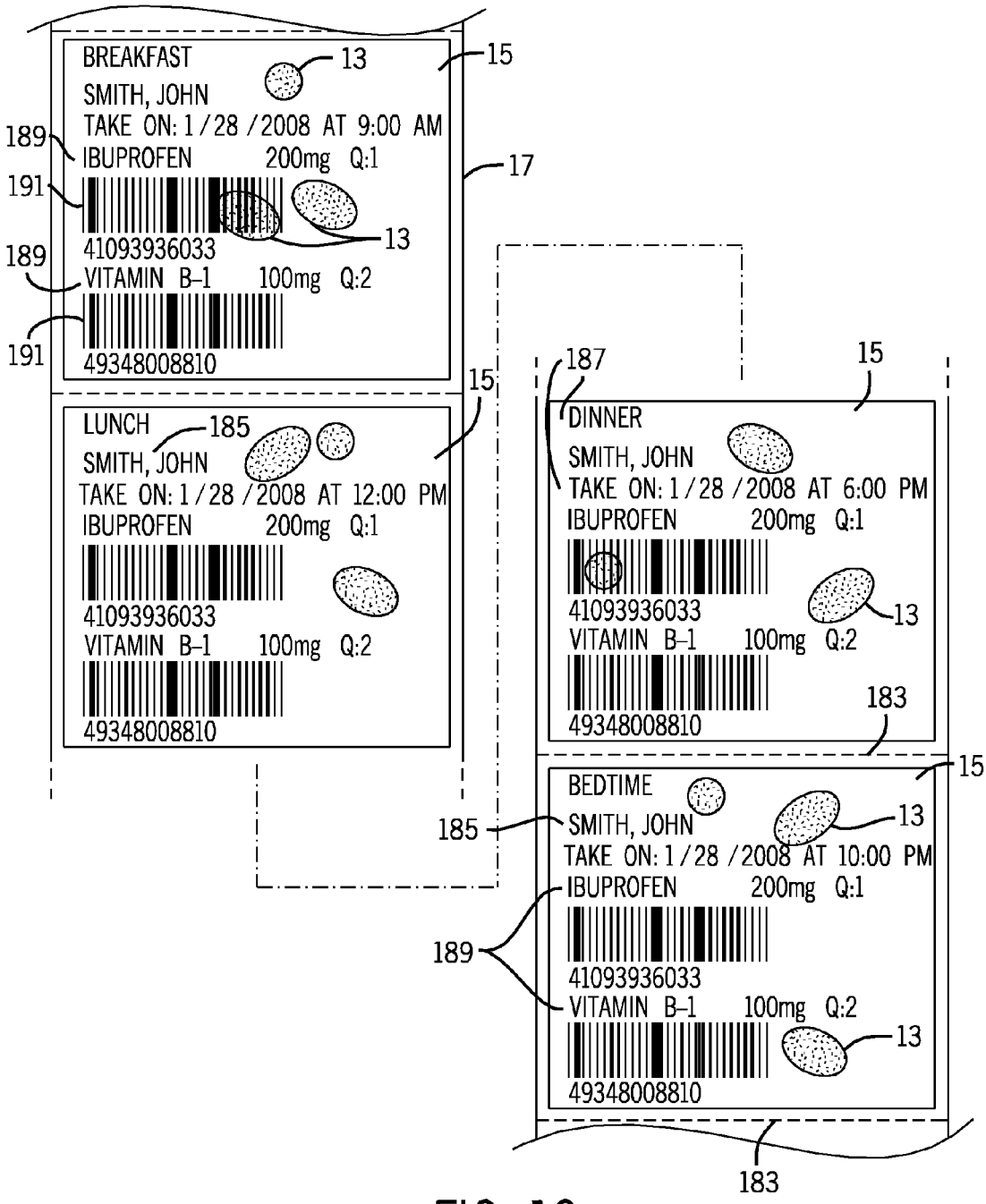
FIG. 10 is a portion of an exemplary pouch package web.

Referring further to FIGS. 7, 9 and 9A, a spring-loaded detent, or ball plunger, 95 is provided on spool-mounting portion 77 to detachably secure a spool 21 to spindle 73. Detent 95 moves axially in and out to permit a technician to slide a spool 21 onto or off of spindle 73 (for spool 21 loading or replacement) while also contacting spool core 195 shoulder 197 to prevent a spool 21 from falling off of spindle 73 during spooler 11 operation.

As illustrated in FIGS. 7, 9, 9A and 16, collar 97 is clamped to spindle spool-mounting portion 77. A pair of pins 99, 101 extend away from collar 97 for engagement with spokes 103 of spool 21 hub 105 core 195 to drive spool 21 rotation as described herein.

Figure 8:
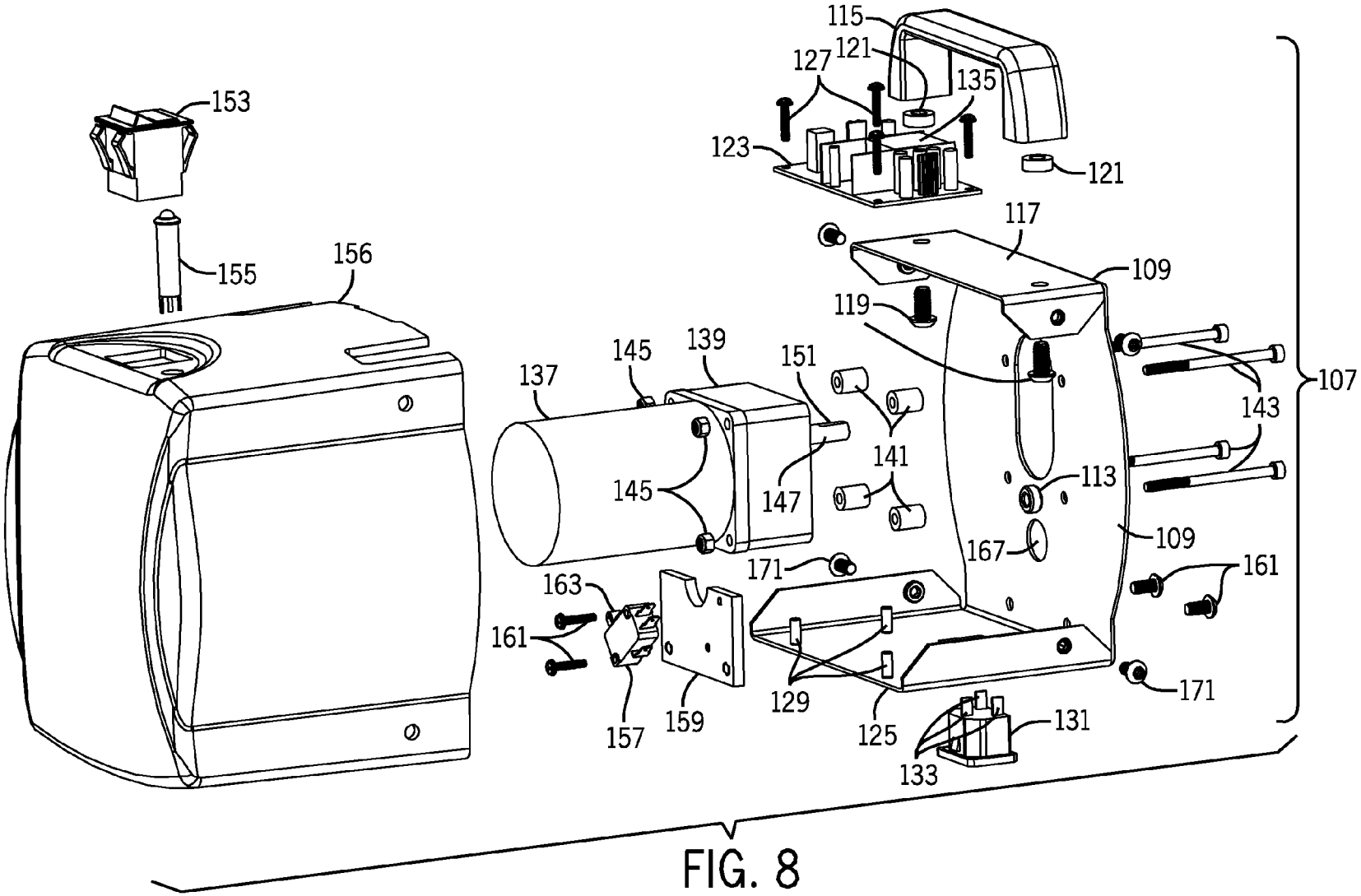
FIG. 8 is an exploded view of an exemplary spooler drive apparatus.

Referring next to FIGS. 7-8, an exemplary drive apparatus 107 for powering spool 21 rotation through spindle 73 is shown. Drive apparatus 107 is in power or torque-transmission relationship with spool 21 mounted on spindle 73.

Exemplary drive apparatus 107 is secured to spooler support structure 25 by mount 109. Mount 109 is secured to an upper end of post 29 by a pair of bolts 111 threaded into corresponding weld nuts (one shown 113) attached to mount 109. Handle 115 is secured to upper mount portion 117 in a slightly spaced-apart manner by a pair of fasteners 119 inserted through standoffs 121. Printed circuit board 123 is fastened above lower mount portion 125 by screws 127 seated in standoffs 129. Power cord receptacle 131 is secured to mount lower portion 125 with conductors 133 in electrical power-transmission relationship With an AC to DC voltage power supply 135 mounted on circuit board 123. In the example, power supply 135 supplies 5 Volts DC power to motor 137 through an appropriate wiring harness (not shown). Power cord 138 connected to power cord receptacle 131 may be connected to a standard 120V AC power source, such as a wall outlet, to supply electrical power to drive apparatus 107 power supply 135.

Motor 137 is preferably a DC 15 Watt permanent magnet motor mated to a reduction gear head 139 providing an 18 to 1 gear reduction in this example. SPG Co., Ltd. of Korea is a source of such motors 137. Motor 137 and gear head 139 are spaced from mount 109 by standoffs 141 and are secured with respect to mount 109 by bolts 143 inserted through standoffs 141 and lock nuts 145.

Referring to FIGS. 7-9, gear head 139 output shaft 147 is seated in opening 149 in spindle drive-engagement portion 79. Set screws 93 seated in slot 151 secure spindle 73 to drive apparatus 107 for co-rotation of spindle 71 and output shaft 147.

An on/off switch 153 and light emitting diode (LED) power indicator 155 are secured to drive apparatus housing 156. Housing 156 is secured to mount 109 by screws 171. LED indicator 155 is energized to indicate that motor 137 is energized when on/off switch 153 is closed. On/off switch 153 and LED indicator 155 are connected to DC power supply 135 through a suitable wiring harness (not shown). When switch 153 is in the "on" position, spooler 11 rotates spindle 73 and spool 21 thereon unless drive apparatus 107 is de-powered by operation of control apparatus 52. When switch 153 is in the "off" position, spooler 11 is de-powered.

Referring now to FIGS. 7-8 and 15A-15C, the micro-switch 157 forming part of control apparatus 52 is secured to plate 159 by screws 161. Plate 159 is secured to mount 109 by screws 161. Micro-switch 157 is connected to DC power supply 135 through an appropriate wiring harness (not shown). The exemplary micro-switch 157 is provided to control electrical power supplied by power supply 135 to motor 137 of drive apparatus 107 as now described.

Figure 15A:
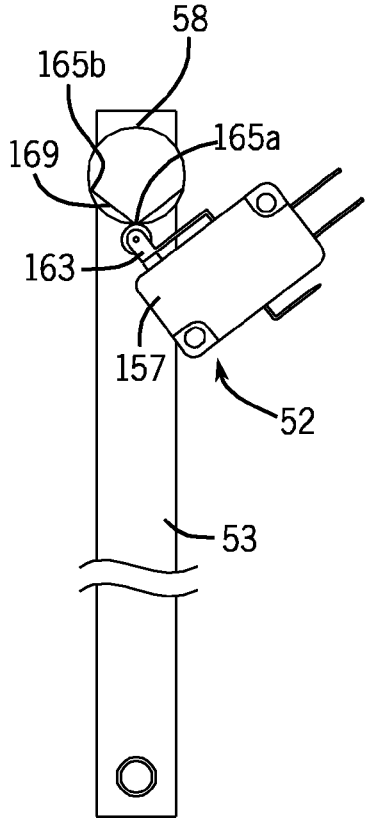
FIG. 15A is a schematic illustration showing operation of an exemplary spooler control when the spooler is in the position of FIG. 12.
Figure 15B:
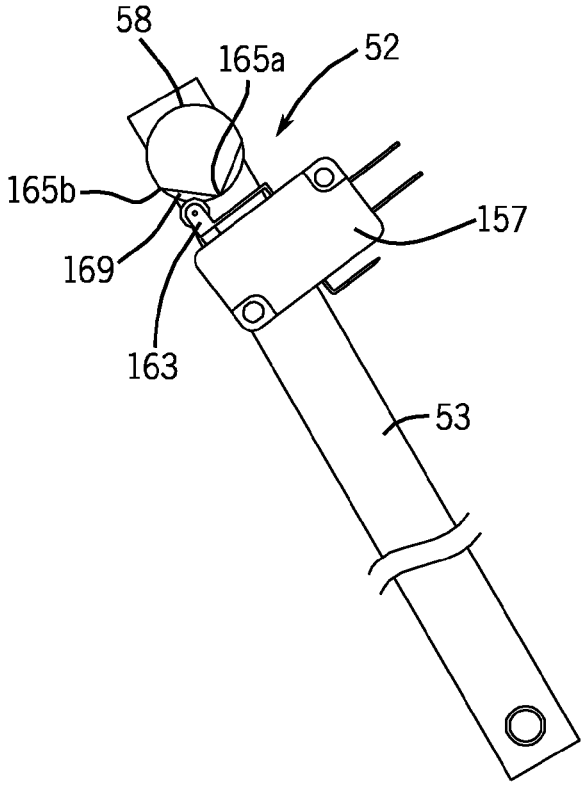
FIG. 15B is a schematic illustration showing operation of an exemplary spooler control when the spooler is in the position of FIG. 13.
Figure 15C:
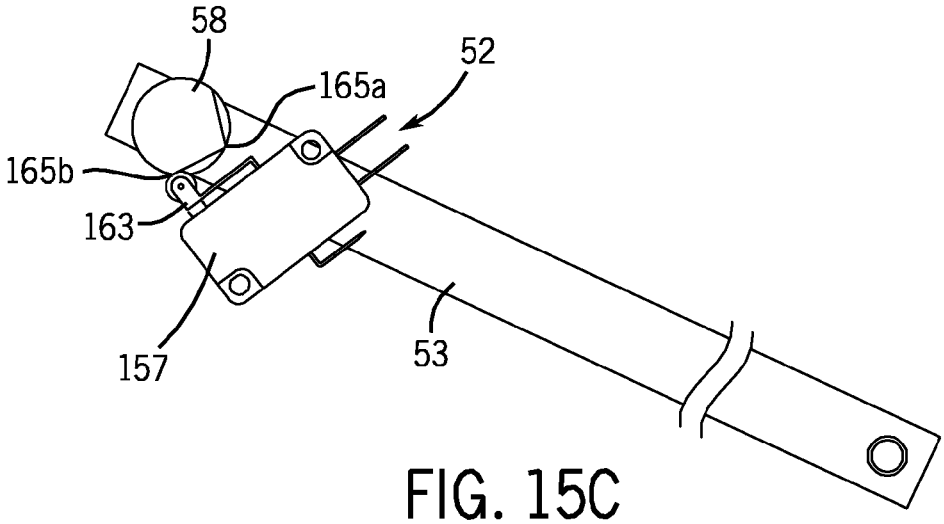
FIG. 15C is a schematic illustration showing operation of an exemplary spooler control when the spooler is in the position of FIG. 14.

FIGS. 15A-15C schematically illustrate operation of the exemplary control apparatus 52. In FIGS. 15A and 15C, micro-switch contact 163 is urged toward switch 157 by contact with a respective cam surface 165*a* or 165*b* of cam 58 when arm 53 is in the lowered and, alternatively, in the raised positions shown. As further illustrated in FIG. 15B, contact 163 is out of contact with cam 58 when facing cam flat surface 169 enabling contact 163 to be biased outward from switch 157.

Micro-switch 157 opens when cam surfaces 165*a* or 165*b* urge contact 163 toward switch 157 preventing electrical power from being supplied to motor 137 by power supply 135 and stopping spool 21 rotation when on/off switch 153 is in the "on" position. When micro-switch 157 contact 163 faces flat surface 169 of cam 58 and is out-of-contact with cam 58, micro-switch 157 closes permitting motor 137 to be energized when on/off switch 153 is in the "on" position.

As shown in FIG. 15A, contact 163 contacts a cam surface 165*a* when tensioner assembly 51 arm 53 is in a home or rest position, shown as generally vertical in the example. This arm 53 position is representative of a state in which no web 17 is being wound onto spool 21 (FIGS. 1-5, 9, 12) or a state immediately after an attendant has severed web 17 output from packager 19. When web 17 is severed, web 17 is no longer in tension, arm 53 is no longer supported by web 17 and arm 53 lowers to the position shown in FIGS. 1-5, 9, 12 and 15A.

As shown in FIG. 15C, contact 163 also contacts a cam surface 165*b* when tensioner assembly 51 arm 53 is lifted up from the home position by approximately 50° with roller 63 supported on web 17 and placing tension on web 17. In the example, this state occurs when automatic tablet packager 19 stops output of web 17. Continued rotation of spool 21 with output of web 17 from packager stopped increases tension on web 17, lifting arm 53 up in this example. Switch 157 is open in the states of FIGS. 15A and 15C, deactivating motor 137 and preventing spooler 11 operation even if on/off switch 153 is in the "on" position.

As represented by FIG. 15B, micro-switch 157 is closed in any tension arm 53 position between the positions shown in FIGS. 15A and 15C. With micro-switch 157 closed, spooler 11 is in an operational state when on/off switch 153 is placed in the "on" position.

Figure 18A:
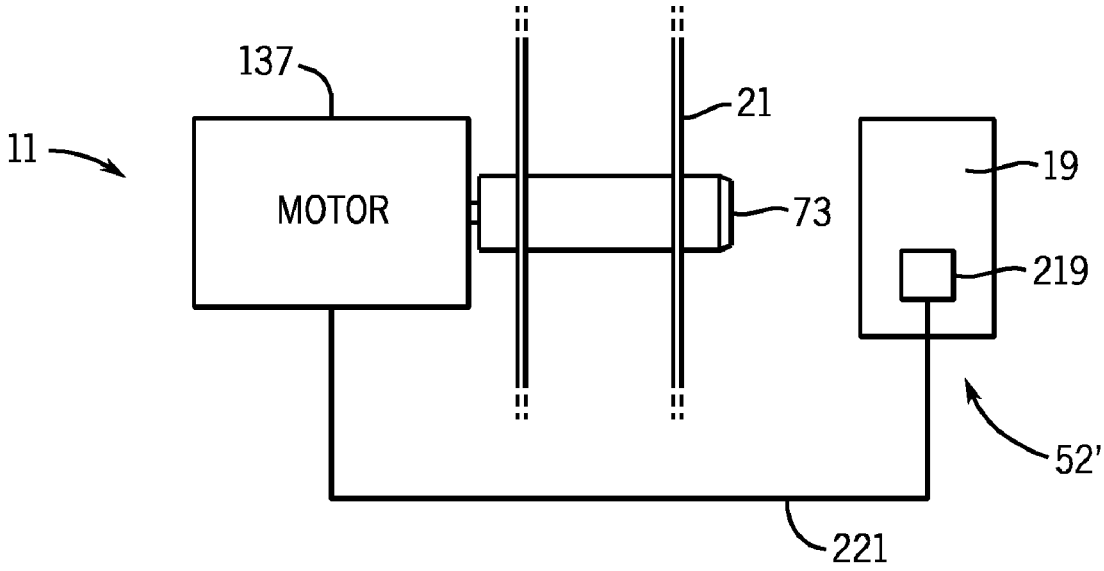
FIGS. 18A and 18B are schematic diagrams illustrating further spooler control apparatus embodiments.
Figure 18B:
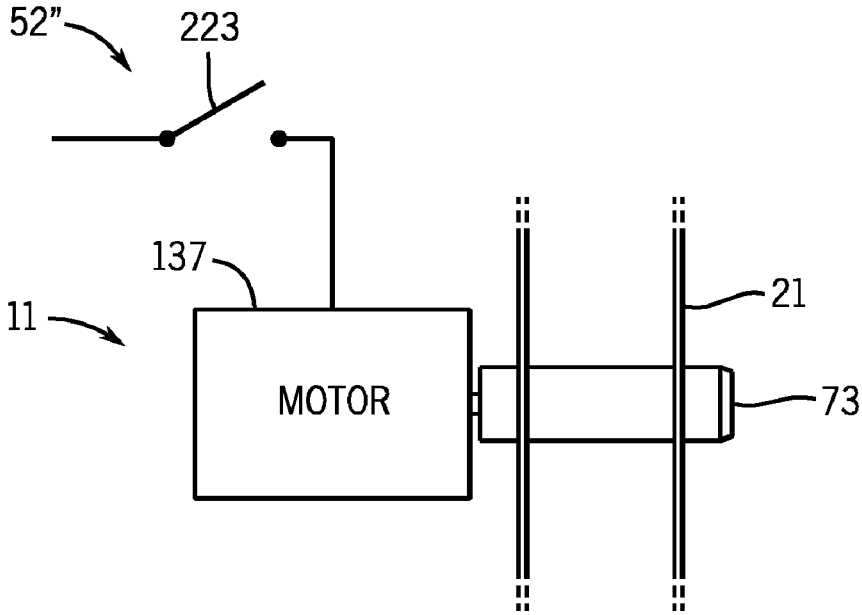

Referring to FIGS. 18A and 18B, control apparatus 52, other than tensioner assembly 51 and cam-operated micro-switch 157, may be utilized to control spooler 11 operation. As an example, the spooler control apparatus 52' may be the control apparatus 219 for the automatic tablet packager 19. In such an embodiment, spooler 11 is operatively connected to tablet packager 19 control apparatus 219 through an interface represented by line 221. When the automatic tablet packager 19 stops further web 17 output, the packager 19 controller 219 stops the spooler 11, for example by opening a switch (not shown) de-powering drive apparatus 107 motor 137 and stopping further spool 21 rotation.

By way of further example, a control apparatus 52" in the form of a current-sensing or torque-sensing switch 223 may be provided to stop spooler 11 operation when packager 19 stops further output of pouch package web 17. Such a switch 223 stops spooler 11, for example, by de-powering drive apparatus 107 motor 137 thereby stopping further spool 21 rotation. Switch 223 is responsive to either an increase in motor 137 torque or current draw which occurs when output of web 17 from packager 19 is stopped yet spool 21 is driven to rotate by motor 137. Continued rotation of spool 21 places tension on web 17 and creates resistance to spool 21 rotation. Such resistance causes a motor-stall condition, increasing motor 137 current draw and torque. When current or torque approach a threshold, switch 223 may be set to open and to de-power drive apparatus 107 motor 137. A control (not shown) may be provided to periodically close switch 223, powering drive apparatus 107 motor 137. Switch 223 would remain closed if current or torque were below the threshold indicative of resumed packager 19 operation and, alternatively, switch 223 would open if current or torque were determined to be above the threshold, indicative that packager 19 had not resumed pouch package web 17 output.

While switch 157 would be unnecessary in these alternative control apparatus embodiments, tensioner assembly 51 could optionally be used, particularly as a guide to direct web 17 onto spool 21.

An exemplary spool 21 is shown in FIGS. 1-2, 4-6, 9, 9A, 12-14 and 16-17. Spool 21 is provided to receive pouch package web 17 wound thereon. As illustrated in FIG. 10, an exemplary pouch package web 17 includes medication-containing pouch packages 15 formed therein and one or more medication 13 in each pouch 15. A typical web 17 is formed of lightweight film-type material by a form-fill-seal packaging module 173 within automatic tablet packager 19 as shown schematically in FIG. 11. Material used to form web 17 should be sufficiently flexible to permit ease of winding web 17 onto spool 21, preferably in a compact roll.

Figure 11:
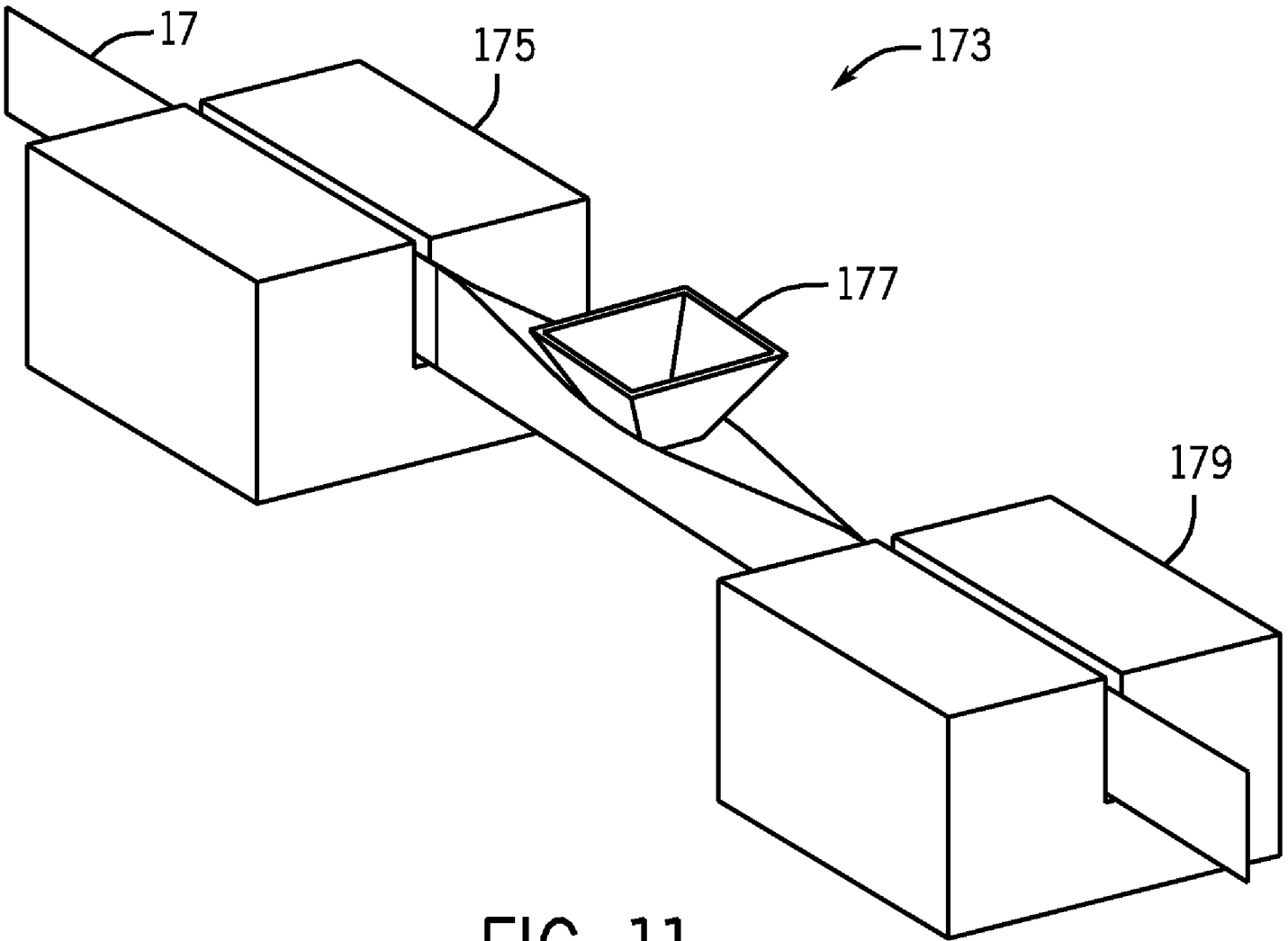
FIG. 11 is a schematic illustration of an exemplary form-fill-seal module of an automatic tablet packager.

Referring further to FIG. 11, module 173 includes a printer 175 which prints information of the type described herein on folded web 17. Medication 13 is loaded into folded packaging material which will form web 17 by means of hopper 177 at spaced-apart intervals. A sealer and perforator unit 179 seals each pouch, for example by sonic welding, and makes a perforation line 183 between each pouch 15 permitting each pouch 15 to be easily severed from web 17.

As shown in FIG. 10, information provided by printer 175 on each pouch 15 can include the patient name 185, instructions for taking the medication 187, medication identification 189 and machine-readable information such as one or more bar code 191 identifying the medication or providing other information about the prescription. The completed pouch package web 17 is output through a port 193 in automatic tablet packager 19 as shown in the examples of FIGS. 12-14.

Referring again to FIGS. 1-2, 9-9A and 16, spool 21 includes a hub 105 with a spindle-receiving portion core 195 having radial spokes 103. Core 195 of hub 105 defines opening 199 which is sized to be slightly larger than spindle spool-mounting portion 77 to permit spool 21 to slide onto and off of spindle 73. In the example, hub 105 core 195 defines a cylindrical opening 199 provided to receive the generally cylindrical spool-mounting portion 77. Other complementary shapes of spool-mounting portion 77 and opening 199 may be used. For example, portion 77 and opening 199 could have complementary rectangular shapes.

In the example, a pair of circular sidewalls 201, 203 extend radially outward from spool hub 105 to restrain lateral movement of package material web 13 wound onto hub 105 in a roll. A leading end of web 17 output from packager 19 may be secured to spool 21 hub 105 to commence winding of web 17 onto spool 21 by any suitable means, such as by adhesive tape or a clip (not shown) on spool 21.

Spool 21 is preferably made of lightweight materials, facilitating handling by pharmacy personnel. Hub 105, core 195 and sidewalls 201, 203 may, for example, be made of lightweight plastic materials, metal or combinations of materials.

As illustrated in FIGS. 9 and 9A, spool 21 is positioned on spindle 73 so that hub 105 core 195 is adjacent collar 97. Spring-loaded detent 95 is urged against core shoulder 197 as previously described. In this position, pins 99, 101 extend between respective spokes 103. Rotation of spindle 73 urges pins 99, 101 against the respective spoke 103 to rotate spool 21 to take up packaging material web 13.

Figure 17:
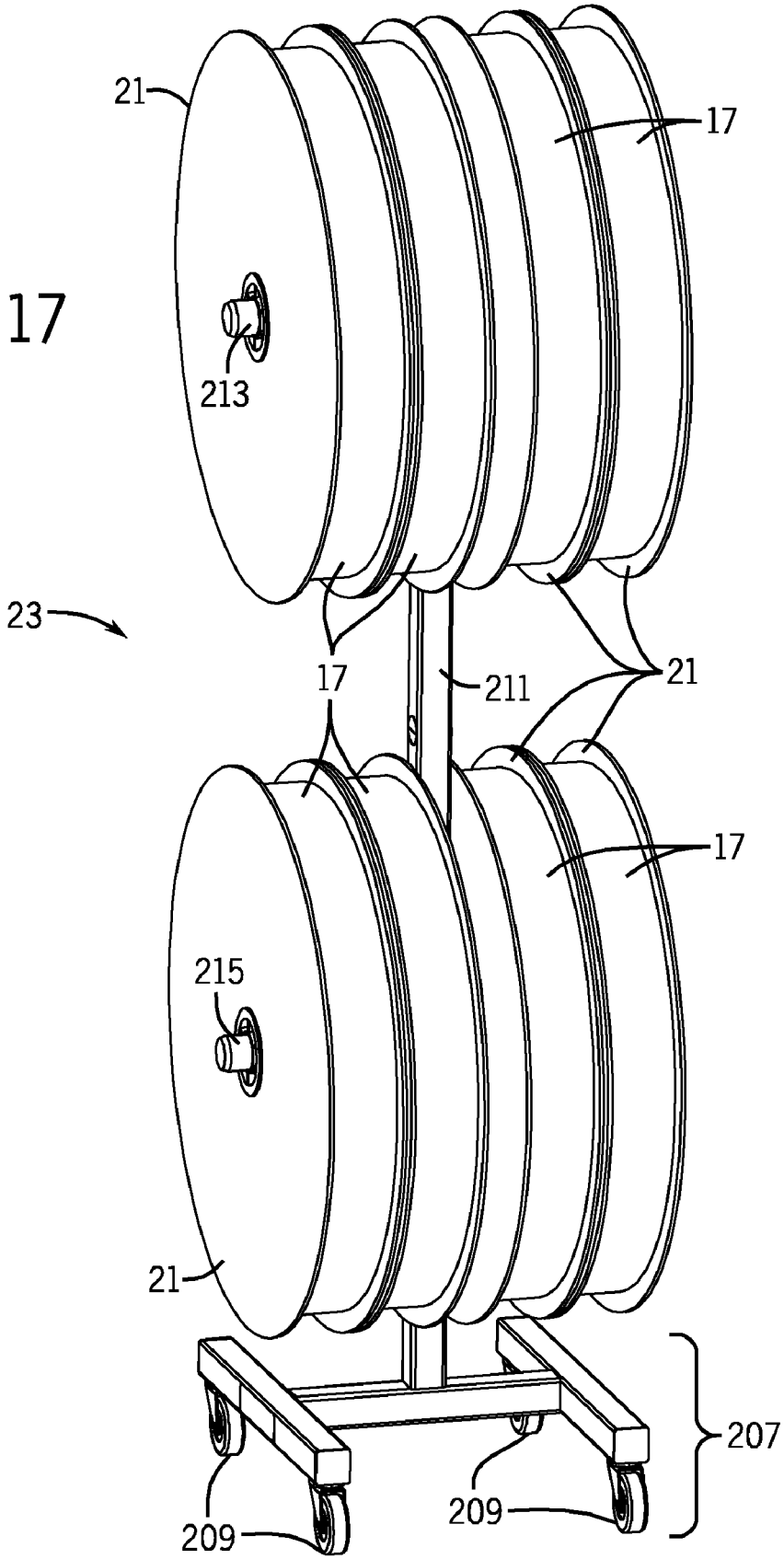
FIG. 17 is a perspective view of an exemplary storage and moving rack, shown loaded with plural spools containing pouch package web.

Referring now to FIG. 17, a rack 23 may be provided to store or transport spools 21. Exemplary rack 23 is shown holding eight separate spools 21, each loaded with pouch package web 17. Rack 23 may include a base 207 with caster wheels 209 and an upright post 211. Each post 211 may be provided with arms 213, 215 extending outwardly therefrom. Spools 21 are received on arms 213, 215 inserted through inner hubs 195. Rack 23 is preferably made of lightweight tubular material, such as extruded aluminum tube. Rack 23 may be stationary and not include wheels 209, if desired.

Operation of exemplary spooler 11 will now be described in connection with exemplary automatic tablet packager 19. A pharmacy technician first positions spooler 11 adjacent automatic tablet packager 19. Power cord 138 is plugged into a power source, such as a wall power outlet. Tensioner arm 53 will be in the home position shown in FIGS. 12 and 15A. Cam surface 165*a* acts against contact 163 opening micro-switch 157 and preventing operation of spooler 11. As noted previously, this exemplary feature avoids any possibility of technician injury by premature operation of spooler 11 if on/off switch 153 is in the "on" position.

Next, pouch package web 17 output from automatic tablet packager 19 is guided under roller 63 of tensioner assembly 51 arm 53 and the leading end of pouch packaging web 17 is attached to hub 193 by clip 205. Tensioner arm 53 will be supported by web 17 in an intermediate position such as shown in FIGS. 13 and 15B by tension on web 17. Cam 58 flat surface 169 is space apart from contact 163, closing micro-switch 157. Roller 63 applies force against web 17 placing web 17 in tension.

Automatic tablet packager 19 is next activated to output pouch package web 17 through port 193.

Placement of on/off switch 153 in the "on" position with switch 157 closed, energizes motor 137 to turn spindle 73 through gear head 139 to commence winding of web 17 onto spool 21 in the direction of arrow 217 (FIG. 13). Motor 137 rotates spindle 73 and spool 21 mounted thereon at a rate sufficient to maintain tension on web 17. In the example, providing 5 volts DC power to a 15 volt motor 137 produces a rate of rotational displacement of about 27 rpms. This is a rate which is about equal to the rate of web 17 output from automatic tablet packager 19 even as the diameter of web 13 wound onto spool 21 increases. Sufficient tension is maintained on web 13 by spool 21 rotation and tensioner assembly 51 so that a compact roll of pouch package web 17 is wound onto spool 21.

If automatic tablet packager 19 stops output of web 17, then tension on web 17 by continued rotation of spool 21 in the direction of arrow 217 increases, lifting tensioner arm 53 to the position shown in FIGS. 14 and 15C. In this position, cam surface 165*b* acts against contact 163 to open micro-switch 157, automatically de-powering motor 137 and stopping spool 21 rotation.

When spool 21 is fully loaded with pouch package web 17, the technician severs the web 17 and removes spool 21 from spooler 11. Web 17 may be severed by, for example, tearing web 17 along a perforation line 183 between packages 15 or by cutting web 17 with scissors. Arm 53 is lowered to the position shown in FIGS. 12 and 15A, opening micro-switch 157 and preventing operation of spooler 21 even if on/off switch 153 is in the "on" position. Spool 21 can be loaded on rack 23 for storage or movement to a hospital ward or other location for delivery to the patient or further processing. A replacement spool 21 can be placed onto spindle 21 so that spooler 11 can receive additional pouch package web 17.

While the principles of this invention have been described in connection with specific embodiments, it should be understood clearly that these descriptions are made only by way of example and are not intended to limit the scope of the invention.

What is claimed is:

1. A spooler for taking up a pouch package web output from a pouch package web source comprising:
- a support structure;
- a rotatable spindle secured with respect to the support structure for supporting a spool mounted thereon;
- a drive apparatus in power-transmission relationship with the spindle for powering spindle rotation; and
- a control apparatus operative to stop the drive apparatus responsive to stoppage of pouch package web output from the pouch package web source and to stop the drive apparatus responsive to a reduction in tension on the pouch package web, the control apparatus comprising:
  - a movable arm pivotably attached to the support structure including a roller which rides on the pouch package web, said arm being supported by the pouch package web such that the arm is movable to a first position responsive to increased pouch package we tension resulting from stoppage at the pouch package web output in combination with continued pouch package web take up onto the spool and the arm is movable to a second position responsive to a reduction in tension on the pouch package web;
  - a switch operable to power the drive apparatus when the arm is between the first and second positions and alternatively, to de-power the drive apparatus when the arm is at the first or second position; and
  - a cam which acts on the switch to de-power the drive apparatus when the arm is at the first or second position.

2. The spooler of claim 1 further comprising a spool mounted on the spindle.

3. The spooler of claim 2 wherein the spool is releasably mounted on the spindle.

4. The spooler of claim 3 wherein the spool comprises:
- a hub defining a spindle-receiving opening; and
- a pair of spaced apart sidewalls extending radially outward from the hub.

5. The spooler of claim 1 in combination with a rack for receiving at least one spool.

6. The spooler of claim 1 wherein the cam is associated with the arm and has a cam surface, said cam being displaced by movement of the arm such that the cam surface operates the switch to stop the drive apparatus when the arm is at the first of second position.

7. A method for management of a pouch package web output from a pouch package web source comprising:
- positioning a spooler adjacent to the pouch package web source;
- associating the pouch package web from the pouch package web source with a spool mounted on spooler;
- outputting the pouch package web from the pouch package web source;
- rotating the spool with the spooler to wind the pouch package we into a roll on the spool;
- moving a tensioner in contact with the pouch package web to a first position responsive to an increase in pouch package web tension from stopping pouch package web outputting in combination with continued spool rotating or, alternatively, moving the tensioner to a second position responsive to a decrease in pouch package web tension; and
- stopping spool rotation by contacting a switch with a cam responsive to tensioner movement to the first or, alternatively, the second position such that the switch operates to stop spool rotating when the tensioner is at the first or second position.

8. The method of claim 7 further comprising:

severing the pouch package web, said severing resulting in loss of the pouch package web tension; and stopping spool rotation further includes contacting the switch with the cam such that the switch is opened to stop spool rotating when the tensioner is at the second position.

9. The method of claim 7 further comprising severing of the pouch package web output from the pouch package web source once an amount of the pouch package web is wound onto the spool.

10. The method of claim 9 further comprising removing the spool from the spooler, said spool including the amount of pouch package web.

11. The method of claim 10 further comprising placing the removed spool onto a storage rack.

12. A spooler for taking up a pouch package web output from a pouch package web source comprising:

a support structure;

a rotatable spindle secured with respect to the support structure for supporting a spool mounted thereon;

a drive apparatus in power-transmission relationship with the spindle for powering spindle rotation; and control apparatus operative to stop the drive apparatus responsive to stoppage of pouch package web output from the pouch package web source and to stop the drive apparatus responsive to a reduction in tension on the pouch package web, the control apparatus comprising:

a movable arm pivotably attached to the support structure including a roller which rides on the pouch package web, said arm being supported by the pouch package web such that the arm is movable to a first position responsive to increased pouch package web tension resulting from stoppage of the pouch package web output in combination with continued pouch package web take up onto the spool and the arm is movable to a second position responsive to a reduction in i:ension on the pouch package web;

a switch operable to power the drive apparatus when the arm is between the first and second positions and altemative.y, to de-power the drive apparatus when the arm is at the first or second position; and a contact element associated with the arm which cooperates with the switch to de-power the drive apparatus when the arm is at the first or second position.

13. The spooler of claim 12 further comprising a spool mounted on the spindle.

14. The spooler of claim 13 wherein the spool is rekasably mounted on the spindle.

15. The spooler of claim 14 wherein the spool comprises:

a hub defining a spindle-receiving opening; and a pair of spaced apart sidewalls extending radially outward from the hub.

16. The spooler of claim 12 in combination with a rack for receiving at least one spool.

17. A method for management of a pouch package web output from a pouch package web source comprising:

positioning a spooler adjacent to the pouch package web source;

associating the pouch package web from the pouch package web source with a spool mounted on the spooler;

outputting the pouch package web from the pouch package web source;

rotating the spool with the spooler to wind the pouch package web into a roll on the spool;

moving a tensioner in contact with the pouch package web to a first position responsive to an increase in pouch package web tension from stopping pouch package web outputting in combination with continued spool rotating or, alternatively, moving the tensioner to a second position responsive to a decrease in pouch package web tension; and stopping spool rotation by contacting a switch with a contact-element associated with the ternsioner responsive to tensioner movement to the first or, alternatively, the second position such that the switch operates to stop spool rotating when the tensioner is at the first or second position.

18. The method of claim 17 further comprising:

severing the pouch package web, said severing resulting in loss of the pouch package web tension; and stopping spool rotation further includes contacting the switch with the contact element such that the switch is opened to stop spool rotating when the tensioner is at the second position.

19. The method of claim 18 further comprising removing the spool from the spooler, said spool including an amount of pouch package web.

20. The method of claim 19 further comprising placing the removed spool onto a storage rack.

* * * * *

UNITED STATES PATENT AND TRADEMARK OFFICE

CERTIFICATE OF CORRECTION

PATENT NO. : 7,954,747 B2
APPLICATION NO. : 12/139236
DATED : June 7, 2011
INVENTOR(S) : Chudy et al.

It is certified that error appears in the above-identified patent and that said Letters Patent is hereby corrected as shown below:

In column 1, line 66, delete “heeded” and insert --needed--.

In column 2, line 51, after the words “web from” delete “,”.

In column 10, claim 1, line 21, delete “we” and insert --web--.

In column 10, claim 1, line 22, delete “at” and insert --of--.

In column 11, claim 8, line 9, delete “rotating” and insert --rotation--.

In column 11, claim 12, line 44, delete “alternative.y” and insert --alternatively--.

In column 12, claim 14, line 3, delete “rekasably” and insert --releasably--.

In column 12, claim 17, line 29, delete “ternsioner” and insert --tensioner--.

Signed and Sealed this
Sixth Day of March, 2012

David J. Kappos

David J. Kappos
*Director of the United States Patent and Trademark Office*